US009742073B2

(12) United States Patent
Capozzoli et al.

(10) Patent No.: US 9,742,073 B2
(45) Date of Patent: Aug. 22, 2017

(54) METHOD FOR MANUFACTURING AN APERIODIC ARRAY OF ELECTROMAGNETIC SCATTERERS, AND REFLECTARRAY ANTENNA

(75) Inventors: Amedeo Capozzoli, Pozzuoli (IT); Claudio Curcio, Nola (IT); Angelo Liseno, Capua (IT); Giuseppe D'Elia, Pozzuoli (IT); Pietro Vinetti, Acquappesa (IT); Giovanni Toso, Haarlem (NL)

(73) Assignee: Agence Spatiale Europeenne, Paris (FR)

( * ) Notice: Subject to any disclaimer, the term of this patent is extended or adjusted under 35 U.S.C. 154(b) by 627 days.

(21) Appl. No.: 13/395,628

(22) PCT Filed: Sep. 16, 2010

(86) PCT No.: PCT/IB2010/002531
§ 371 (c)(1),
(2), (4) Date: Jun. 28, 2012

(87) PCT Pub. No.: WO2011/033388
PCT Pub. Date: Mar. 24, 2011

(65) Prior Publication Data

US 2012/0268340 A1 Oct. 25, 2012

(30) Foreign Application Priority Data

Sep. 16, 2009 (EP) ..... 09425356

(51) Int. Cl.
*H01Q 15/16* (2006.01)
*H01Q 19/18* (2006.01)
(Continued)

(52) U.S. Cl.
CPC ..... *H01Q 19/18* (2013.01); *H01Q 15/14* (2013.01); *H01Q 19/10* (2013.01); *H01Q 21/0018* (2013.01)

(58) Field of Classification Search
CPC ..... H01Q 15/14; H01Q 19/10; H01Q 19/18; H01Q 21/0018
(Continued)

(56) References Cited

U.S. PATENT DOCUMENTS 5,283,590 A * 2/1994 Wong ..... 343/754
5,543,809 A 8/1996 Profera, Jr.
(Continued)

FOREIGN PATENT DOCUMENTS

CA 2 205 873 A1 11/1998
EP 0 891 003 A1 1/1999

OTHER PUBLICATIONS

International Search Report and Written Opinion for Application No. PCT/IB2010/002531 dated Mar. 16, 2011.
(Continued)

*Primary Examiner* — Minh Trinh
(74) *Attorney, Agent, or Firm* — Alston & Bird LLP

(57) ABSTRACT

The application discloses a one or two dimensional array of electromagnetic scatterers n scatterers (ED), whereby the aforementioned scatterers (ED) are arranged aperiodically on a curved line or surface (S). Further, the application describes a reflectarray antenna comprising at least one such array of electromagnetic scatters (ED) and at least one receiving and/or transmitting feed (F), cooperating with said array to generate an antenna beam A method for designing and manufacturing sais array and said antenna is explained. The method optimizes in a several stages all degrees of freedom in order improve the performance of reflectarrays, increase the flexibility thereof and/or the conformity thereof
(Continued)

with design specifications (radio pattern) and/or allowing said specifications to be satisfied with a smaller number of scatters.

12 Claims, 4 Drawing Sheets

(51) Int. Cl.
*H01Q 15/14* (2006.01)
*H01Q 19/10* (2006.01)
*H01Q 21/00* (2006.01)

(58) Field of Classification Search
USPC ..... 29/600–601, 592.1; 343/702, 782–783, 343/836, 912, 700 MS
See application file for complete search history.

(56) References Cited

U.S. PATENT DOCUMENTS

| | | | | |
|---|---|---|---|---|
| 6,031,506 | A * | 2/2000 | Cooley et al. | 343/840 |
| 2006/0092087 | A1 | 5/2006 | Lange | |
| 2007/0188378 | A1 | 8/2007 | Li | |
| 2009/0211079 | A1* | 8/2009 | Toso et al. | 29/600 |
| 2012/0268340 | A1* | 10/2012 | Capozzoli et al. | 343/836 |

OTHER PUBLICATIONS

Bucci, O. M. et al., *A New Appproach to the Power Pattern Synthesis of Relfectarrays*, URSI EMTS (2004) 1053-1055.
Bucci, O. M. et al., *Power Pattern Synthesis of Reconfigurable Conformal Arrays With Near-Field Constraints*, IEEE Transactions on Antennas and Propogation, vol. 52, No. 1 (2004) 132-141.
Capozzoli, A. et al., *A Design Technique of Reflectarrays With Improved Frequency Performances*, The second European Conference on Antennas and Propogation 2007, EuCAP 2007, Feb. 26, 2008.
Kurup, D. G. et al., *Design of an Unequally Spaced Reflectarray*, IEEE Antennas and Wireless Propogation Letters, vol. 2 (2003) 33-35.
Tienda, C. et al., *Analysis of Parabolic Reflectarray in Dual-Reflector Configuration*, Antennas and Propagation (EUCAP), 2010 Proceedings of the Fourth European Conference on, IEEE, Apr. 12, 2010, 5 pages.
Balanis, C. A., *Antenna Theory: Analysis and Design*, John Willey & Sons, New York, 1997.
Blaser, M., *Lower Bounds for the Multiplicative Complexity of Matrix Multiplication*, Comput. Complex., vol. 8, No. 3, Dec. 1999, 203-226.
Bucci, O.M. et al., *An Advanced Relfectarray Design Technique*, Proc. of the 28th ESA Antenna Workshop on Space Antenna Syst. and Tech., Noordwijk, The Netherlands, May 31-Jun. 3, 2005, pp. 455-459.
Bucci, O. M. et al., *Power Pattern Synthesis of Reflectarrays: Comparison Between Two Approaches*, Proc. of the XV Riunione Nazionale di Elettromagnetismo, Cagliari, Italy, Sep. 13-16, 2004, CD ROM.
Bucci, M. et al., *Intersection Approach to Array Synthesis*, IEE Proc. Pt. H, Micro., Antennas Prop., vol. 137, No. 6, Dec. 1990, pp. 349-357.
Bucci, O. M. et al., *The Scattering Matrix for Reflectarray Antennas*, Atti Della Fondazione Giorgio Ronchi, LXV,1,17 (2010).
Capozzoli, G. et al., *Power Pattern Synthesis of Reconfigurable Shaped-Beam Reflectarrays*, Proc. of the 9th Int. Conf. of Electromagn. In Adv. Appl., Turin, Italy, Sep. 12-16, 2005, pp. 819-822.
Capozzoli, A. et al., *Fast Power Pattern Synthesis of Conformal Relfectarrays*, Proc. of the IEEE Int. Symp. on Antennas Prop., San Diego, CA, Jul. 5-11, 2008, CD ROM.
Capozzoli, A. et al., *Global Optimization and Antennas Synthesis and Diagnostics, Part One: Concepts, Tools, Strategies and Performances*, Progr. Electromagn. Res. PIER, vol. 56, 2006, pp. 195-232.
Capozzoli, A. et al., *Power Pattern Synthesis of Multifeed Reconfigurable Reflectarrays*, Proc. of the 29th ESA Antenna Workshop on Multiple Beams Reconfig. Antennas, Noordwijk, The Netherlands, Apr. 18-20, 2007, CD ROM.
Capozzoli, C. et al., *Sensitivity to Positioning Errors in Aperiodic Arrays*, XVII Riunione Nazionale di Elettromagnetismo (RiNEM), Lecce, Italy, Sep. 2008, pp. 15-19.
Fourmont, K., *Non-Equispaced Fast Fourier Transforms with Applications to Tomography*, J. Fourier Anal. Appl., vol. 9, No. 5, Sep. 2003, pp. 431-450.
Frigo, M. et al., *The Design and Implementation of FFTW*, Proc. of the IEEE, vol. 93, No. 2, Feb. 2005, pp. 216-231.
Lee, J. Y. et al., *The Type 3 Nonuniform FFT and Its Applications*, J. Comput. Physc., vol. 206, No. 1, Jun. 205, pp. 1-5.
Marnat, L. et al., *Accurate Synthesis of a Dual Linearly Polarized Reflectarray*, 3rd EUCAP, European Conference on Antennas and Propagation, Berlin, Mar. 2009.
Meriah, S. M. et al., *Design of a Thinned Microstrip-Antenna Reflectarray Using a Genetic Algorithm*, Microwave and Optical Technology Letters (MOTL), vol. 46, Issue 6, Sep. 20, 2005, pp. 559-562.
Rinnooy, A. H. G. et al., *Stochastic Global Optimization Methods Part I: Clustering Methods*, Math. Program., vol. 39, No. 1, Sep. 1987, pp. 27-56.
Rinnooy, A. H. G. et al., *Stochastic Global Optimiation Methods Part II: Multi Level Methods*, Math. Program., vol. 39, No. 1, Sep. 1987, pp. 57-78.
Office Action for corresponding European Application No. 10 785 508.2 dated Aug. 7, 2015.
Office Action for corresponding European Application No. 10 785 508.2 dated Jul. 11, 2013.

* cited by examiner

METHOD FOR MANUFACTURING AN APERIODIC ARRAY OF ELECTROMAGNETIC SCATTERERS, AND REFLECTARRAY ANTENNA

FIELD OF THE INVENTION

The invention relates to a one- or two dimensional, aperiodic and non-planar (or "conformal") array of electromagnetic scatterers. The invention also relates to an aperiodic and conformal (multi)reflectarray, i.e. an antenna system constituted by one or more cascade stages of reflectors and aperiodic and conformal reflecting arrays (equivalently known as reflectarrays).

BACKGROUND OF THE INVENTION

"Reflectarray" antennas were introduced in the 1950's as an alternative to parabolic or spherical reflector antennas. The idea underpinning this antenna typology consists in replacing the continuous and curved reflective surface of the parabolic reflector with a (generally periodic and planar) array of passive electromagnetic scatterers, that can be easily produced in printed technology. In a reflectarray, the curvature of the reflector is simulated by the phase shift introduced by the various scatterers, a phase shift which in turn depends on the form and dimension thereof. As with reflector antennas, it is also possible to use systems comprising a plurality of cascaded reflectarrays, for example in the Cassegrain or Gregorian configuration.

Reflectarrays have intermediate characteristics between those of reflector antennas and those of array antennas. They are particularly suitable for use in satellites and radars, and can be used to make different types of antenna, and in particular "pencil beam" antennas, that are able to radiate electromagnetic energy in very restricted angular ranges, "multi beam" antennas, which offer the opportunity to produce with a single radiating structure a plurality of radiation patterns with different characteristics, and "steered beam" antennas. In the two latter cases, multiple feed systems are typically used.

Publications [1-3] describe advanced synthesis methods which can be used to obtain shaped beam "reflectarray" antennas, with radiation patterns appropriately shaped so as to obtain a specific illumination, typically for satellite applications.

Publication [4] describes a configurable reflectarray, in which the radiation pattern can be modified dynamically, by acting on the phase introduced by the electromagnetic scatterers by means of "varactor" diodes integrated into said elements, the bias voltage of which may be varied.

Publication [5] describes a reflectarray able to control two linear polarizations simultaneously.

Reflectarrays are generally planar (the scatterers are arranged on a plane surface, or exceptionally on a plurality of non-parallel plane surfaces) and periodic (the scatterers are arranged on a periodic grid), which means that particularly effective synthesis algorithms can be used. Publications [6] and [19] describe non-planar, but nonetheless periodic reflectarrays, in the sense that the projection of the scatterers on a plane is in fact periodic.

Publication [20] describes a "sparse" planar reflectarray, in which the scattering elements are arranged on a uniform grid, but some of them are eliminated.

Publication [21] describes a planar and aperiodic reflectarray synthesized by means of a genetic algorithm.

SUMMARY OF THE INVENTION

The aim of the invention is to improve the performance of reflectarrays, increasing the flexibility thereof and/or the conformity thereof with design specifications, and/or allowing said specifications to be satisfied with a smaller number of scatterers.

One object of the invention, which allows these aims to be fulfilled, is a one- or two-dimensional array of electromagnetic scatterers, characterized in that said scatterers are arranged aperiodically on a curved line or surface (aperiodic conformal reflectarray).

A further object of the invention is a reflectarray antenna that comprises:

- at least one one- or two-dimensional array of electromagnetic scatterers in which said scatterers are arranged aperiodically on a curved line or surface; and
- at least one receiving and/or transmitting feed, cooperating with said array to generate an antenna beam.

The inventive antenna may also comprise a plurality of said arrays, arranged in cascade and cooperating with each other and with the feed to generate said antenna beam.

SUMMARY OF THE INVENTION

The invention combines the benefits of reflectarrays and the flexibility of conformal structures, with the advantages deriving from the variability in the spacings, constitution and orientation of the elements constituting the array.

Aperiodicity significantly increases the degrees of freedom (design parameters that can be acted upon) in respect of antenna system synthesis. In fact, where the antennas are aligned periodically the elements are equispaced in accordance with a regular and uniform grid. Consequently, irrespective of the number of elements, the inter-element spacing is the sole geometric parameter in the array: a single parameter where one-dimension is involved, just two in the case of two-dimensions. Therefore, the excitations of the radiating/scattering elements fundamentally constitute the unknowns to be identified through the synthesis process to obtain an antenna system with the required characteristics.

In an aperiodic array, on the other hand, the position of every single radiating element becomes a potential design parameter, which can be controlled appropriately in the synthesis stage to satisfy the required specifications with regard to the radiative behaviour of the radiating structure.

The use of an aperiodic array therefore provides further degrees of freedom, which may help to obtain antenna systems with comparable or possibly enhanced performance relative to conventional systems, in terms of both radiative behaviour and operating band. In fact, variable spacing can be utilized to attenuate the problems typically associated with periodic antenna arrays. In the first place, the positions of the elements can be optimized in order to reduce the beam squint effect or more generally it is possible to operate on the positions of the elements in order to reduce the variations in the radiation pattern as the frequency varies.

Generally speaking, the arbitrariness of the positions of the elements in an aperiodic array prohibits the periodicity of the radiative behaviour of the array, also attenuating the "grating lobes" effect, and consequently, allows the spacing limits in the periodic case to be exceeded, at least in principle.

The different orientation of the elements from cell to cell may be useful in order to control not only the co-polar but also the cross-polar signal component.

As regards the "conformal" character of the array, the aperiodic conformal (multi)-reflectarry system constituting the subject matter of this invention offers on the one hand a greater degree of integrability, making the structure adaptable, to the installation site and to the compliance with mechanical and architectural constraints, and on the other hand can be used as a further design parameter to improve the electromagnetic performance thereof. In fact, for example, the geometry along which to arrange the scatterers may be appropriately optimized to confer a more broadband behaviour, suitably compensating for the dispersion paths from the primary electromagnetic source to the individual scatterer elements.

It is true that, from a technological point of view, it is more complex to produce a conformal reflectarray than a planar array. Nevertheless, a conformal reflectarray with a relatively simple surface can effectively replace a highly shaped continuous reflector, the manufacture of which would be much more complex and costly.

Nevertheless, the non-planarity of the support surface of the scatterers and the aperiodicity of the array make it impossible to use known algorithms to synthesize reflectarrays. In these conditions, until now the synthesis of conformal aperiodic relectarrays has been impossible, in practice, because it is too complex from a computational point of view. The application, in the non-linear/non-planar case, of the genetic algorithm in publication [21] would also be so complex, computationally, as to be of no practical interest. The invention also allows this basic problem to be resolved. Indeed, a further object of the invention is a method for manufacturing an aperiodic, planar or conformal reflectarray, that comprises:

- a design phase, comprising the identification of a set of physical and/or geometrical parameters of said array as a function of design specifications; and
- a phase of physically making the array based on said parameters;

characterized in that said design phase uses a multi-stage synthesis algorithm to identify a set of said physical and/or geometrical parameters of the array which optimizes an appropriate cost function, in which every stage except the first takes as initial values of said parameters those provided by the previous stage, wherein said synthesis algorithm comprises:

- a first stage, based on a continuous modelling of the array;
- one or more intermediate stages, based on a phase-only discrete modelling of the array; and
- a final refinement stage.

Different specific embodiments of the inventive method constitute the subject matter of the dependent claims.

BRIEF DESCRIPTION OF THE DRAWINGS

The invention will now be described in detail, with reference to the appended figures, which show.

DETAILED DESCRIPTION OF THE INVENTION

Figure 1:
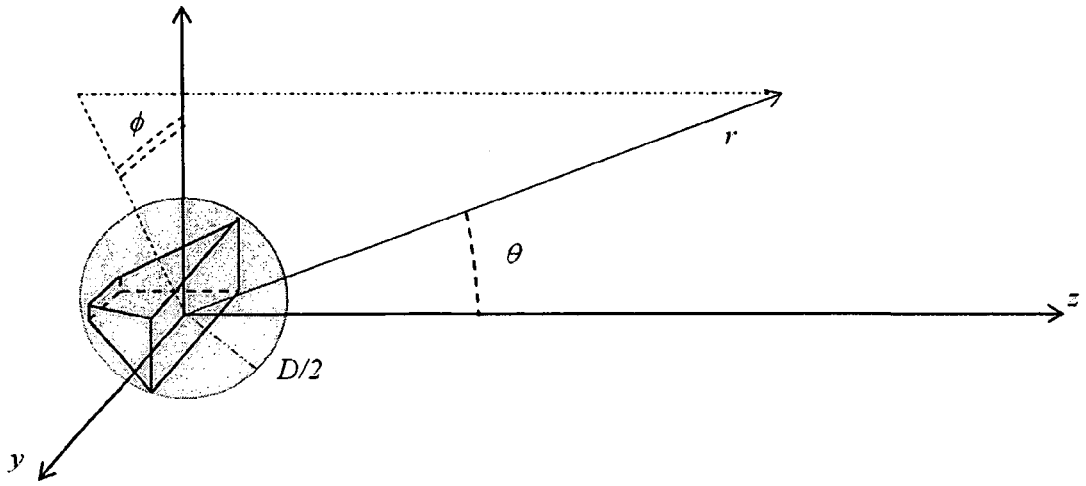
FIG. 1, a horn antenna used as a reflectarray feed.

Before beginning the description of the invention itself, some terms need to be precisely defined:

Antenna (or radiating element) is taken to mean a device able to radiate/receive an electromagnetic field.

Antenna array is taken to mean a collection of radiating/receiving elements appropriately arranged in space and appropriately controlled/interconnected.

Linear antenna array is taken to mean an antenna array whose elements are arranged in accordance with a segment.

Planar antenna array is taken to mean an antenna array whose elements are arranged in accordance with a limited plane portion.

Periodic linear antenna array is taken to mean a linear antenna array whose elements are equispaced.

Periodic planar antenna array is taken to mean a planar antenna array whose elements are placed in correspondence with every node of a regular and uniform 2D grid (even if the elements are different from each other, so that the array is not genuinely periodic).

Aperiodic linear antenna array is taken to mean a non-periodic linear antenna array.

Aperiodic planar antenna array is taken to mean a non-periodic planar antenna array.

Aperiodic conformal 1D antenna array is taken to mean an aperiodic antenna array whose elements are arranged in accordance with a limited curve different from a segment. Aperiodic conformal 2D antenna array is taken to mean an aperiodic array of antennas arranged in accordance with a limited surface different from a limited plane portion. Hereinafter the term aperiodic conformal antenna array will be used to refer either to an aperiodic conformal 1D antenna array or to an aperiodic conformal 2D antenna array. Where conformal arrays are concerned, "aperiodic" means that the projection of the elements on a plane or segment is not periodic. An array in which the elements are arranged in correspondence with some, but not with all, of the nodes of a uniform grid is not considered to be "aperiodic".

Reflector antenna array (reflectarray) is taken to mean a periodic (linear or planar) antenna array, whose elements are constituted by electromagnetic scatterers and which is provided with a feed. Feed is taken to mean either an individual feed (operating in transmission or reception), or a set of separate feeds.

Reflector is taken to mean a reflective surface.

Aperiodic conformal (multi)reflectarray is taken hereinafter to mean an antenna system constituted by one or more feeds, by at least one aperiodic conformal reflectarray and, possibly, by reflectors, all operating in cascade. This last structure is the subject matter of this invention in as much as the design specifications are satisfied by acting upon:

- the scattering characteristics of the reflectarray elements;
- the geometry of the surfaces constituting the reflector antenna arrays and of any reflectors;
- the position and orientation of each scattering element on the relevant surfaces.

In this way a high number of degrees of freedom (design parameters) are available to satisfy stringent design specifications.

The following definitions use an Oxyz reference frame originating in the region of the space occupied by the antenna; this reference frame is shown in FIG. 1.

The far zone of an antenna system is taken to mean all the points in space which are found at a distance, r from the origin of the antenna system so as to satisfy the following three conditions:

$r \gg \lambda$ $r \gg D$ $r > 2D^2/\lambda$ where D indicates the diameter of the smallest sphere centred in the origin and containing the radiator and $\lambda$ is the wavelength in the void.

The far field of an antenna is taken to mean the electromagnetic field radiated in its far zone. This will hereinafter be indicated by the symbol $\underline{E}\infty(r, \theta, \phi)$.

Near zone is taken to mean all the points in space complementary to the far zone.

Near field is taken to mean the field radiated in the near zone. As a rule, as it gets close to the antenna system, the near zone is subdivided into Fresnel zone, near zone and reactive zone.

An antenna pattern is taken to mean the vector $$\underline{E}(\vartheta, \varphi) = \lim_{r \to +\infty} (re^{j\beta r} E_\infty(r, \vartheta, \varphi)),$$

where $\beta = 2\pi/\lambda$.

The effective height in transmission of an antenna is taken to mean the vector $\underline{h}_T(\theta, \phi) = \underline{F}(\theta, \phi) 2\lambda/(j\zeta I_0)$ in which $I_0$ is the antenna supply current. An antenna is "electrically large" if the effective height thereof is much greater (at least by a factor of 3) than the operating wavelength.

Plane of polarization is taken to mean the plane, orthogonal to the direction of observation, in which the far field vector lies.

Co-polar component of the far field is taken to mean the far field component which is useful for receiving the signal.

Cross-polar component of the far field is taken to mean the far field component, orthogonal to the co-polar component.

Gain is taken to mean the function, $$G(\vartheta, \varphi) = 2\pi \frac{|\underline{E}(\vartheta, \varphi)|^2}{\zeta P_{ing}}$$

where $\zeta$ is the intrinsic impedance of the void and $P_{ing}$ is the antenna input power [1, 2].

Co-polar partial gain is taken to mean the function $$G_{co}(\vartheta, \varphi) = 2\pi \frac{|\underline{E}_{co}(\vartheta, \varphi)|^2}{\zeta P_{ing}},$$

where $F_{co}$ is the co-polar component of the pattern. Similarly, the cross-polar gain is defined as $G_{cr}$, corresponding to the cross-polar component $\underline{F}_{cr}$ of $\underline{F}$.

Isolation in polarization is taken to mean the ratio between the values of the relevant partial gains in respect of the cross-polar and co-polar component.

An antenna band is taken to mean all the frequencies in which the radiative and circuit behaviours of the antenna do not depart from the nominal ones beyond a pre-set tolerance.

The following definitions refer to a chosen cross-section of the pattern.

Lobe is taken to mean the entire angular region containing a maximum of $G_{co}$, relative or absolute, and in which $G_{co}$ diminishes monotonously relative to said maximum.

Main lobe is taken to mean the lobe referring to the absolute maximum.

Side lobe is taken to mean a lobe referring to a relative maximum.

Beamwidth at half-power of an antenna (beamwidth–$BW_{3dB}$) is taken to mean the amplitude of that portion of the main lobe in which $2G_{co} \geq (G_{co})_{MAX}$.

Side lobelevel (SLL) is taken to mean the ratio between $(G_{co})_{MAX}$ and the assumed maximum $G_{co}$ in the corresponding side lobe.

Said definitions make it possible to describe the transmission behaviour of the antenna and, where a reciprocal antenna is involved, the reception behaviour of the antenna as well. In the case of a non-reciprocal antenna similar parameters may be introduced and appropriately defined in reception. Therefore, hereinafter, solely for simplifying the description, reference will be made to the behaviour of the antenna in transmission.

As previously discussed, the object of the invention is an aperiodic conformal (multi)-reflectarray, i.e. an antenna system constituted by one or more feeds, by at least one aperiodic conformal reflectarray and, possibly, by reflectors, all operating in cascade. Hereinafter only the case where the reflectarray or arrays are two-dimensional will be considered explicitly, but the one-dimensional case is also part of the invention.

The system has in its simplest configuration, as an aperiodic conformal reflectarray, a feed which illuminates an array of scatterers which is developed along a pre-assigned surface or curve of the space with distribution of the scattering elements on the limited surface or curve under consideration, in principle with no constraints.

Figure 2:
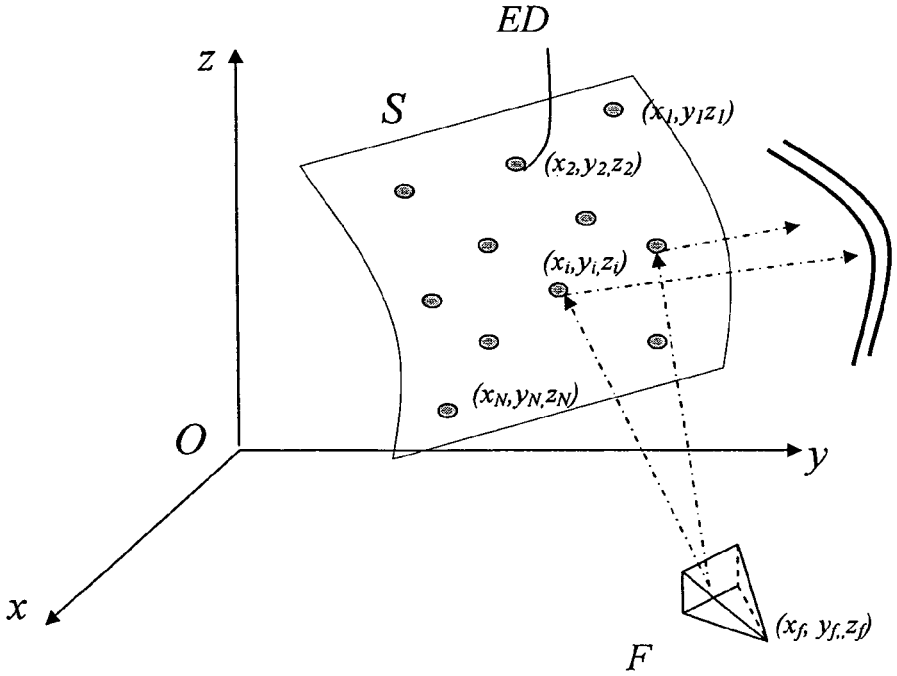
FIG. 2, the layout of an aperiodic and conformal, two-dimensional, reflectarray.

By way of example, in FIG. 2 a diagrammatic illustration is given of a conformal reflective array which is developed along a surface S of the space Oxyz. The scatterers ED are located at points on the surface identified by the coordinates $(x_n, y_n, z_n)$, n=1, 2, . . . N−1, while the feed F is represented diagrammatically at the point of coordinates $(x_f, y_f, z_f)$. It is important to note that the elements, identified with identical grey circles in FIG. 2, may in reality differ from each other both in dimensions, characteristics and orientation so as to further increase the degrees of freedom.

Figure 3:
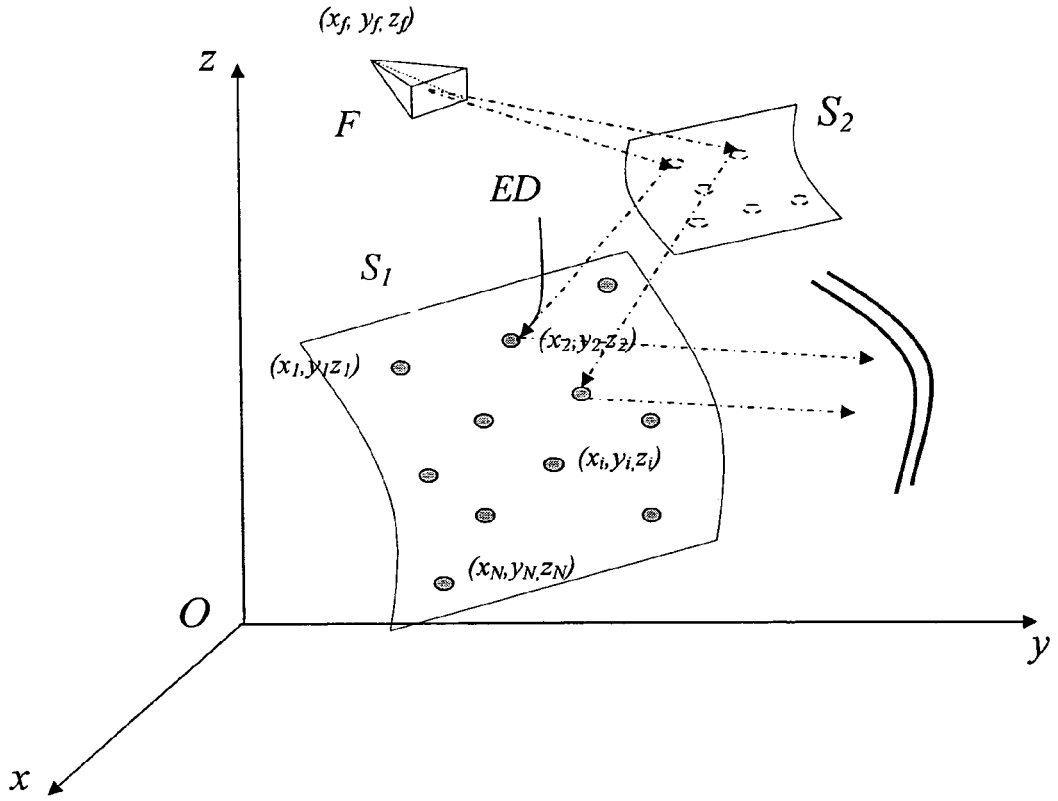
FIG. 3, the layout of an aperiodic and conformal, two-dimensional, multi-reflective system.

In more sophisticated configurations, those of aperiodic conformal multi-reflectarrays, a plurality of reflective arrays together with one or possibly more reflectors may be combined with each other in cascade, such as for example in a Cassegrain or Gregorian reflector, to produce a high performance antenna system. In FIG. 3 the layout is given of an aperiodic conformal multi-reflectarray in the case of two-dimensional arrays which are developed along two surfaces $S_1$ and $S_2$, which act as primary reflector and secondary reflector respectively.

Typically, the scatterers implementing the array are scattering elements in printed technology. However, the proposed system does not exclude the possibility of using other scattering structures to implement the array.

The spacings and composition of the individual cells can be varied but with some warnings.

In fact, it has to be noted that, in an aperiodic reflectarray, the variable spacings—and possibly the variable dimensions of the elements inside the individual cells—also cause the dimensions of the array portions not physically occupied by the elements themselves to vary. Said portions must be kept small since they generate an unwanted input of reflected power which combines non-coherently with the inputs generated by the elements themselves. This component proves to be particularly significant in the direction specular to the direction of incidence of the primary feed, degrading the antenna gain.

Moreover, as with the periodic case, the inter-element spacing cannot be reduced below a certain threshold, to prevent the unavoidable mutual coupling between adjacent elements from altering the nominal behaviour thereof and to avoid having to use excessively complex analysis methods.

For these reasons, the aperiodic conformal (multi)-reflectarry forming the subject matter of the invention may also offer a distribution of the positions which is aperiodic, but constrained in terms of minimum and maximum inter-element distance.

Taking into account the particular characteristics of the invention, and in accord with what has been set out above, once the design specifications are set, the synthesis procedure must allow a reliable and accurate determination to be made of a high number of degrees of freedom of the structure as regards:

1. the geometry of the reflective surfaces;
2. the characteristics of the individual reflective elements;
3. the position and orientation of the individual reflective elements.

Moreover, it must be able to satisfy the necessary constraints with regard to both the accommodating surfaces and the minimum and maximum spacing between the elements.

There follows a general description of what will be described in detail in subsequent paragraphs.

Typically reflector or reflectarray antenna synthesis algorithms determine the structure that satisfies the specifications through iterative procedures intended to identify the global optimum—i.e. the maximum and minimum—of an appropriate cost function (target functional). Particularly in respect of electrically large structures, said procedures make use of "local" optimization methods based on the evaluation of the target functional gradient, since the use of global optimization procedures cannot be proposed on account of the high computational cost. Alternatively, global optimization techniques can be used, following a drastic reduction in the number of parameters to be sought, in the first stages of multi-stage approaches [7, 8] able to guarantee the reliability of the solution in the very first phases of the synthesis and steadily to refine the accuracy thereof in subsequent phases through gradually more accurate local methods.

Since synthesis techniques require the evaluation of the field radiated by the structure and (possibly) of the target functional gradient (using local methods) at each stage of iteration, the computational complexity of the synthesis algorithm to be employed in the design of an aperiodic and conformal (multi)-reflectarray must be appropriately controlled. Moreover, if the number of degrees of freedom in play is high, gradient-based procedures are more likely to remain trapped in sub-optimum solutions, represented by local cost function minima. Therefore, the synthesis algorithm must be also equipped with appropriate (possibly polynomial) representations of the degrees of freedom which may, during global optimization via multi-stage approaches or in local optimizations during the intermediate optimization stages, reduce the number of parameters to be identified thereby strengthening the reliability of the identified solution, further reducing the computational burden and guaranteeing the control and satisfaction of the design constraints.

As regards the evaluation of the radiated field (and possibly of the gradient), the greatest difficulty is dictated by the fact that, for said structure, the elements are, by definition, not equispaced. Moreover, since the elements are in principle different from each other, it is not possible to define an array factor [9]. Again, the elements are arranged on non-planar surfaces. Lastly, the design constraints may have to be applied on non-uniform grids. For these reasons, it is not possible to establish a Fourier transform relation between the excitations of the radiating elements and the far field (or for the gradient calculation), which precludes the use of fast calculation procedures based on the use of the Fast Fourier Transform (FFT) (possibly based on recent and particularly effective FFT algorithms, such as FFTW [10]), as happens for planar and periodic structures of identical elements, if the constraints are applied on uniform grids. This has a negative effect on the computational cost of the synthesis algorithm in as much as the complexity of the radiated field and gradient calculation increases from $N^2 \log N$, which represents the cost of a two-dimensional FFT, with N being the number of radiating elements involved, to a complexity which grows as $N^3$ if it were required to evaluate the radiated field simply by adding the inputs of the individual radiating elements ("brute force" approach).

If it is not possible or it is not useful to simplify the radiative model used (as required in the final optimization phases of multi-stage approaches), it is nonetheless possible to formulate the radiated field and gradient evaluation by means of appropriate matrix products, so that it proves possible to use algorithms based on calculation routines optimized ad-hoc, which, depending on the particular symmetries of the matrices it is possible to use, achieve a polynomial complexity greater than $N^2 \log N$, but less than $N^3$ [11].

However, in many cases of practical interest, the geometry of the reflective surfaces does not depart markedly from that of planar surfaces. Moreover, a "phase-only" electromagnetic model of the radiated field may be useful in multi-stage approaches to obtain first reliable solutions or intermediate solutions, even if they are not accurate. Based on these assumptions, it is possible to implement appropriate expansions in series of the scattered field, in which each term is identified by a Fourier transform relation [6]. In these cases, even when the grids on which the elements lie and/or with regard to which the constraints are imposed are not regular, it is possible to use non-uniform transform algorithms (NUFFT) which degenerate into the standard FFT for uniform grids and which have the same computational complexity as a FFT. In further detail, if the element grid alone is non-uniform, it is possible to use a "type-1" NUFFT [12]. When the constraint grid alone is non-uniform a "type-2" NUFFT [12] can be used. The "type-3" transform can be used when both the grids are non regular [13].

Lastly, as regards the use of global optimization techniques, "multistart" algorithms, characterized by high computational effectiveness and reliability through the nesting of local optimization stages within the global search, may be efficiently adopted [14, 15].

1. Accurate Model of the Field Radiated by an Aperiodic Conformal (Multi)-Reflectarray In this paragraph the "accurate" model will be shown of the field radiated by an aperiodic conformal (multi)reflectarray, used, as reported below, in the first phases of the multi-stage synthesis for the fast provision of first reliable, although approximate, solutions. For the sake of simplicity, it will be referred here to a single reflective surface, the general case of an arbitrary number of reflective surfaces being easily deducible from what is said below.

Figure 4:
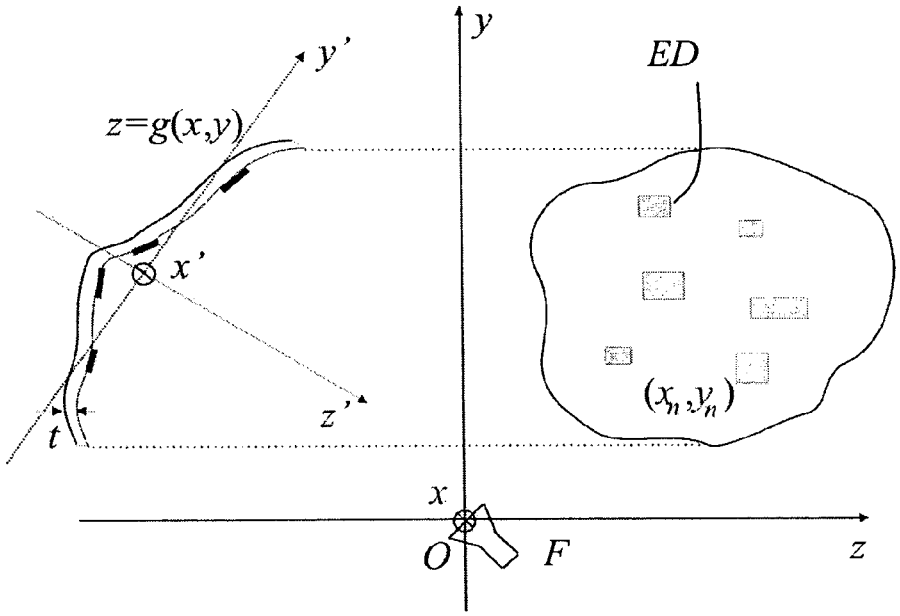
FIGS. 4 and 5, different reference frames used for the modelling of a "reflectarray" antenna based on an aperiodic and conformal, two-dimensional, reflectarray.

The reference geometry of an aperiodic conformal (multi)-reflectarray (provided for the sake of simplicity, as stated, with a single reflective surface) is shown in FIG. 4

The reflective surface is illuminated by a primary source positioned at the centre of the cartesian reference frame Oxyz and radiating a field $\underline{E}_f$ incident on the reflectarray. The reflectarray is constituted by N patches placed on a surface of equation $z=g(x, y)$ at the positions $z_n=g(x_n, y_n)$. Where a single-layer reflective structure is involved, it will be referred to a substrate of thickness t and relative permittivity $\epsilon_r$, and multi-layer structures can be dealt with in a similar way, although a plurality of design parameters are available.

Figure 5:
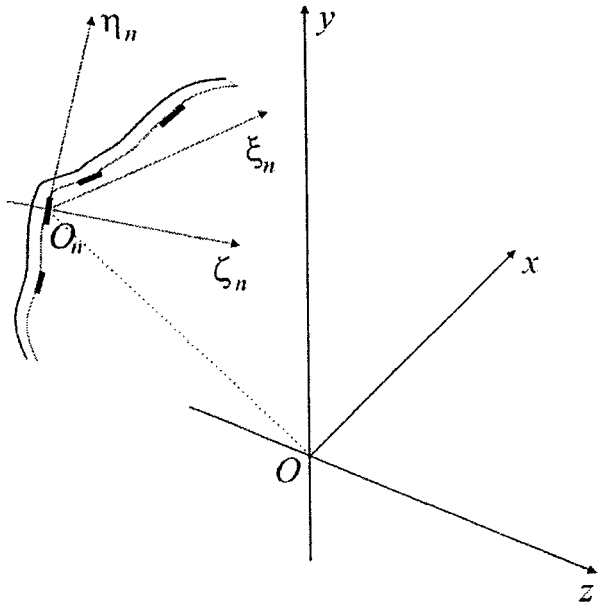

The spherical coordinates of an observation point P positioned in the far zone of the relectarray are shown as (r, θ, ϕ), and a "local" reference frame to the n-th patch as $O_n\xi_n\eta_n\zeta_n$, such that the origin $O_n$ coincides with $(x_n, y_n, g(x_n, y_n))$ and the axis $\zeta_n$ is normal at the surface $z=g(x, y)$ (see FIG. 5).

Assuming that each patch is placed in the far zone of the primary source, the far field of the reflectarray may be written as $$\begin{pmatrix} E_{co} \\ E_{cr} \end{pmatrix}(u, v) = \frac{e^{-j\beta r}}{r}\sum_{n=1}^{N} \underline{\underline{Q}}_n(u, v)\underline{\underline{S}}_n(u, v)\underline{E}_{fn}\, e^{j\beta(ux_n+vy_n+wz_n)} \tag{1}$$

where $E_{co}$ and $E_{cr}$ are the co-polar and cross-polar components of the far field, respectively;

$u=\sin\theta\cos\phi$, $v=\sin\theta\sin\phi$;

$$\underline{\underline{S}}_n = \begin{bmatrix} S_{x\xi_n} & S_{x\eta_n} \\ S_{y\xi_n} & S_{y\eta_n} \end{bmatrix}$$

is the scattering matrix of the n-th element [1];

$\underline{E}_{fn}=(\underline{E}_f\cdot\hat{i}_{\xi_n}, E_f\cdot\hat{i}_{\eta_n})$;

$Q_n$ is the matrix which transforms the cartesian components, in the frame $O_n\xi_n$, ηn, of the field scattered by the n-th patch into the co-polar and cross-polar components of the far field of the reflectarray, and $\beta=2\pi/\lambda$ is the wave number.

It may be seen that the subscript n in the definition of $\underline{S}n$ characterizes its dependence on:

$x_n$, $y_n$ and g;

$\underline{d}_n=(d_{n_1}, d_{n_2}, \ldots, d_{n_L})$ which represents the vector of the control parameters of the n-th patch, in which the control parameters are the parameters which characterize the element and which must be identified during the synthesis process;

the angles $\theta_n$ and $\phi_n$ which define the orientation of the n-th patch in the reference frame $O_n\xi_n\eta_n\zeta_n$;

the direction cosines of the angles of incidence of the primary field $$u_n = \frac{o_n - o}{|o_n - o|}\cdot\hat{i}_x,$$

and $$v_n = \frac{o_n - o}{|o_n - o|}\cdot\hat{i}_y.$$

To recapitulate, in accordance with (1), the evaluation of the co-polar and cross-polar components of the far field requires taking account of 1. the vector aspects of the scattering matrices $\underline{S}_n$ and, in particular, of their dependences a. on the angles of observation of the far field;

b. on the angles of incidence of the primary field;

c. on the spatial orientation of the n-th patch dependent, in its turn, on the (conformal) surface of the reflectarray;

d. on the reflector properties of the n-th patch;

2. the vector aspects with regard to the primary field $\underline{E}_f$ and, in particular, of its dependence a. on $\underline{r}_n=O_n-O$;

b. on the angles of incidence identified by $u_n$ and $v_n$.

In the event of the field incident on the individual patch not being writable in the form of a locally plane wave, a plurality of terms will have to be considered, just as a plurality of terms will have to be considered where a scattering matrix [16] is involved.

2. The Synthesis Algorithm 2.1. Formulating the Algorithm

Once the design specifications are set, the aim of the synthesis algorithm is to determine The support surface g;

The positions of the elements on said surface: $x=(x_1, x_2, \ldots, x_N)$, $\underline{y}=(y_1, y_2, \ldots, y_N)$;

The matrix $\underline{D}$, whose generic element is $d_{n1}$, which expresses the geometrical and physical features of the elements;

The orientations of the elements: $\theta=(\theta_1, \theta_2, \ldots, \theta_N)$ and $\underline{\phi}=(\phi_1, \phi_2, \ldots, \phi_N)$.

As far as the function g is concerned, numeric processing can be carried out representing the function appropriately through its expansion on an appropriate truncated function base, i.e. implementing a "modal development":

$$g(x,y)=\Sigma_{k=1}^{K} s_k\chi_k(x,y) \tag{2}$$

For example, Zernike polynomials can be used as they have the advantage of immediate interpretation in terms of wave front of the radiated field. Naturally, other choices are possible.

It is noted that, since in practice the algorithm is run by a computer, all the functions are expressed in discrete form. This may be considered as a trivial type of "modal development". Hereinafter, the expression "modal development" does not include this trivial case. The use of a "non-trivial" development allows the number of unknowns in the problem to be substantially reduced.

With this approach, the synthesis process will have to determine $\underline{x}$, and $\underline{y}$, $\underline{s}=(s_1, s_2, \ldots, s_K)$ $\underline{D}$, $\underline{\theta}$ and $\underline{\phi}$.

The design specifications are provided in different ways according to whether the synthesis is performed in field or in power.

In more detail:

1. In the case of field synthesis, the modulus and phase of a set of fields compatible with the one wanted in an identified region of interest Ω of the spectral plane (u, v) are assigned.

2. In the case of power pattern synthesis, specifications are assigned with regard to the square modulus of the radiated field (or, equivalently, to the co-polar and cross-polar gain) in the region of interest Ω, typically expressed as a pair of templates (upper and lower), which limit the acceptable values in respect of $|E_{co}|^2$ and $|E_{cr}|^2$ (or, equivalently, $G_{co}$ e $G_{cross}$) (generally speaking, the choice of the square modulus proves to be more suitable, from the point of view of synthesis algorithm reliability, compared with the choice, nonetheless possible, of the modulus alone).

3. In the case of maxmin synthesis, just the spectral region of interest Ω is assigned. The "maxmin" synthesis comprises maximizing a functional minimum; for example, in order to synthesize a shaped beam maximization of the minimum gain within a pre-set pattern may be sought.

In case 1), the synthesis algorithm comprises the minimization of the cost function:

$$\Phi(\underline{x},\underline{y},\underline{s},\underline{D},\underline{\theta},\underline{\phi})=\|A_{co}(\underline{x},\underline{y},\underline{s},\underline{D},\underline{\theta},\underline{\phi})-\boldsymbol{P}_{\mathcal{H}}(A_{co}((\underline{x},\underline{y},\underline{s},\underline{D},\underline{\theta},\underline{\phi}))\|^2+\|A_{cr}(\underline{x},\underline{y},\underline{s},\underline{D},\underline{\theta},\underline{\phi})-\boldsymbol{P}_{\mathcal{H}}(A_{co}((\underline{x},\underline{y},\underline{s},\underline{D},\underline{\theta},\underline{\phi}))\|^2 \quad (3)$$

where $\underline{A}=(A_{co}, A_{cr})$ is the operator, based on the model in eq. (1), which links the aforementioned parameters for identification to the co-polar and cross-polar components of the field $E_{co}$ and $E_{cr}$, respectively, in modulus and phase, $\mathcal{H}$ is the set of functions specified by the aforementioned design specifications, $\boldsymbol{P}_{\mathcal{H}}$ is the projection operator with regard to $\mathcal{H}$.

In case 2), the synthesis algorithm comprises the minimization of the cost function $$\Phi(\underline{x},\underline{y},\underline{s},\underline{D},\underline{\theta},\underline{\phi})=\|A_{co}(\underline{x},\underline{y},\underline{s},\underline{D},\underline{\theta},\underline{\phi})-\boldsymbol{P}_{\mathcal{H}}(A_{co}(\underline{x},\underline{y},\underline{s},\underline{D},\underline{\theta},\underline{\phi}))\|^2+A_{cr}(\underline{x},\underline{y},\underline{s},\underline{D},\underline{\theta},\underline{\phi})-\boldsymbol{P}_{\mathcal{H}}(A_{cr}(\underline{x},\underline{y},\underline{s},\underline{D},\underline{\theta},\underline{\phi}))\|^2 \quad (4)$$

where, in this case, $\underline{A}=(A_{co}, A_{cr})$ is the operator, based on the model in eq. (1), which links the aforementioned parameters for identification to ($|E_{co}|^2$, $|E_{cr}|^2$), $\mathcal{H}$ is the set of non-negative functions belonging to an appropriate Sobolev space W(Ω) and compatible with the design specifications, $\boldsymbol{P}_{\mathcal{H}}$ is the projection operator with regard to $\mathcal{H}$, while $|\ |\cdot|\ |$ is the norm in W(Ω).

Lastly, in case 3), the synthesis algorithm comprises the maximization of the cost function $$\Phi(\underline{x}, \underline{y}, \underline{s}, \underline{D}, \underline{\theta}, \underline{\varphi}) = \min_{(u,v)\in\Omega} G(\underline{x}, \underline{y}, \underline{s}, \underline{D}, \underline{\theta}, \underline{\varphi}) \quad (5)$$

where G is the operator, based on the model in eq. (1), which links the aforementioned parameters for identification to the antenna gain.

Therefore, the problem of synthesizing an aperiodic conformal (multi)-reflectarray is reduced to the global optimization of the functional in (3) or (4), where field or power pattern synthesis is involved, or to a maxmin problem comprising the global optimization of the functional (5).

2.2. Global Optimization of Involved Functionals

The synthesis algorithm of an aperiodic conformal (multi) reflectarray determines the structure that satisfies the specifications by means of iterative procedures for determining the global minimum of the aforementioned cost functions.

For electrically large structures, such procedures mainly use "local" minimization methods based on the evaluation of the target function gradient, since the use of global optimization procedures cannot generally be proposed owing to the high computational cost. However, global optimization techniques can be used, subsequent to a drastic reduction in the number of parameters to be sought, and therefore a model simplification, in the first stages of a multi-stage approach, when necessary. In this way, it is possible to guarantee good reliability for a somewhat rough solution in the very first phases of the synthesis, steadily refining it in subsequent stages in which a computationally more exacting, but more accurate, model is gradually brought into use.

Since synthesis techniques require the evaluation of the field radiated by the structure and (possibly) of the target functional gradient (using local methods) at every iteration stage, the computational complexity of the synthesis algorithm to be employed in the design of an aperiodic and conformal (multi)-reflectarray must be appropriately controlled. Moreover, if the number of degrees of freedom in play is high, local optimization procedures are more likely to remain trapped in sub-optimum solutions, represented by local cost function minima. Therefore, the synthesis algorithm must also be equipped with appropriate (possibly polynomial) representations of the degrees of freedom which may, during global optimization via the multi-stage approach or in local optimizations during the intermediate optimization stages, reduce the number of parameters to be identified thereby strengthening the reliability of the identified solution, further reducing the computational burden, but guaranteeing the control and satisfaction of the physical or design constraints.

Therefore, the synthesis stages in question involve both global and local optimizations. Local optimizations can be carried out with gradient-based algorithms (for example, the self-scaled version of the Broyden-Fletcher-Goldfarb-Shanno procedure).

Alternatively, if the preferred requirement is straightforwardness of implementation with speed of calculation, the synthesis at each stage can be carried out using the so-called iterated projections method [17], generally speaking downstream of model approximations.

2.3. Multi-Frequency Extension

The synthesis problems formulated in paragraph 2.1 can be extended in the event of the specifications being assigned to a set of frequencies.

In further detail, in cases 1) and 2), the functionals to be optimized become $$\Phi(\underline{x},\underline{y},\underline{s},\underline{D},\underline{\theta},\underline{\phi})=\Sigma_i\|A_{co}(\underline{x},\underline{y},\underline{s},\underline{D},\underline{\theta},\underline{\phi},f_i)-\boldsymbol{P}_{\mathcal{H}}(A_{co}(\underline{x},\underline{y},\underline{s},\underline{D},\underline{\theta},\underline{\phi},f_i))\|^2+\Sigma_i\|A_{cr}(\underline{x},\underline{y},\underline{s},\underline{D},\underline{\theta},\underline{\phi},f_i)-\boldsymbol{P}_{\mathcal{H}}(A_{cr}(\underline{x},\underline{y},\underline{s},\underline{D},\underline{\theta},\underline{\phi},f_i))\|^2 \quad (6)$$

in which $f_i$ characterizes the i-th frequency for which the specifications are assigned.

In case 3), the functional to be maximized becomes $$\Phi(\underline{x}, \underline{y}, \underline{s}, \underline{D}, \underline{\theta}, \underline{\varphi}) = \sum_i \min_{(u,v)\in\Omega} G(\underline{x}, \underline{y}, \underline{s}, \underline{D}, \underline{\theta}, \underline{\varphi}, f_i) \quad (7)$$

In principle, said functionals can also be written with reference to a continuous infinity of frequencies, which will correspond, numerically speaking, to an appropriate discretization.

3. The Multi-Stage Synthesis Algorithm

As indicated in the previous paragraph, synthesis algorithm reliability is affected by the problem of the local minima of the functionals for optimization. Moreover, the solution to the problem becomes onerous owing to the fact that it is not possible to use standard FFT routines or they are not of immediate utility.

Therefore, to strengthen solution reliability on the one hand and lessen computational complexity on the other, the synthesis should be carried out using a multi-stage approach, in which the task of the first stages is to provide first more or less rough solutions, referable to simplified radiation models that take only a limited number of degrees of freedom of the structure into consideration. Conversely, the aim of subsequent stages is to refine the solutions identified at previous stages using more accurate radiation models and taking all available design parameters into consideration.

Figure 7:
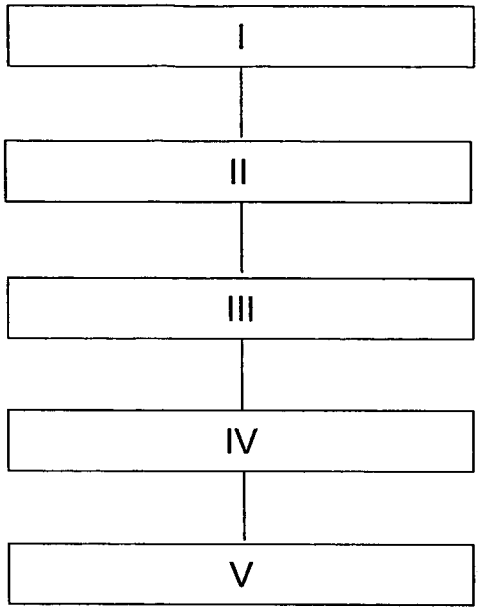
FIG. 7, a flow diagram of the synthesis algorithm.

The synthesis algorithm consists of five stages, where the first (I in the flow diagram in FIG. 7) is based on a "continuous" modelling of the problem, stages #2, #3 and #4—first, second and third intermediate stage, shown as II, III and IV in FIG. 7, are based on phase-only simplified models, while the final refinement stage (V) relies on an accurate radiation model. Every stage takes its initial point to be the outcome of the previous stage, except the first which is however based on a global optimization process. To allow a steady increase in the number of degrees of freedom of the structure so as to guarantee the reliability thereof, use is made, except for stage #5, of modal representations in respect of the unknowns to be identified. Depending on the computation burdens it is required to manage, some stages in the synthesis process can be avoided, or additional stages can be introduced. Moreover, one or more stages—including the initial and final stages—can be repeated a plurality of times, using gradually more comprehensive modal developments of the unknowns. In some cases, the surface (or line) supporting the electromagnetic scatterers can be imposed as a design specification, instead of being determined by the synthesis algorithm. In even more specific cases, it is even possible to lay down that this surface be plane, or constituted by a plurality of plane portions (with one dimension: that said line be a segment or a broken line).

Hereinafter will be presented the different synthesis stages (paragraphs 3.1, 3.4, 3.5, 3.8 and 3.9), the radiation models important to the definition of the radiation and gain operators (paragraphs 3.2 and 3.6) and the strategies used for the fast resolution of the direct problem (paragraphs 3.3, 3.7 and 3.13), the gradient (paragraphs 3.10 and 3.11) and the optimization (paragraph 3.12).

3.1. Stage #1: Synthesis of Modulus and Phase of the Field on the Reflective Surface The aim of this stage, once the design specifications in respect of the co-polar component of the field and in respect of the reflective surface have been set, is to provide a first assessment, albeit a rough one, of the modulus and phase of the reflected field.

Downstream of this stage, the modulus will be used as an assessment of the equivalent tapering, to be implemented by means of an appropriate positioning $(x_n, y_n)$ of the reflective elements, while the identified phase will be used so that initial values are available of the patch control phases for the subsequent synthesis stage based on a phase-only radiation model (described below).

In further detail, the model depended on is as follows $$E_{co}(u, v) = \frac{e^{-j\beta r}}{r} \int\int_{S_{\square}} \mathcal{A}(x, y) e^{j\mathcal{F}(x,y)} e^{j\beta(ux+vy+w_{g_0}(x,y))}\, dxdy, \tag{8}$$

where $z=g_0(x, y)$ denotes the equation of the initial choice in respect of the reflective surface, while $\mathcal{A}$ and $\mathcal{F}$ represent the modulus and the phase to be synthesized. The initial choice of the reflective surface can be dictated by various requirements. For example, if it is required to facilitate a multi-frequency synthesis, a spherical/parabolic surface can be assumed at stage #1 so as to lessen the "feed path length" effect.

To offer an appropriate choice of the number of parameters representing modulus and phase to be sought and to allow the imposition of constraints (see paragraph 4.1), in respect of the functions $\mathcal{A}$ and $\mathcal{F}$, the following representations are used $$\mathcal{A}(x,y)=\Sigma_{n=1}^{N_A} a_n \gamma_n(x,y) \tag{9}$$

and $$\mathcal{F}(x,y)=\Sigma_{n=1}^{N_F} b_n \Pi_n(x,y), \tag{10}$$

against which the parameters $\underline{a}=(a_1, a_2, \ldots, a_{N_A})$ and $\underline{b}=(b_1, b_2, \ldots, b_{N_F})$ become the unknowns to be identified.

Let us assume, for clarifying ideas, the power pattern synthesis case (the other cases may be treated similarly), downstream of (8-10), the present stage in the synthesis algorithm comprises the optimization of the functional:

$$\Phi(\underline{a},\underline{b})=\|A_{co}(\underline{a},\underline{b})-\boldsymbol{P}_{\mathcal{H}}(A_{co}(\underline{a},\underline{b}))\|^2, \tag{11}$$

where now the operator $A_{co}$ connects the modulus and phase $\mathcal{A}$ and $\mathcal{F}$, respectively, according to representations (9) and (10), of the field on the reflective surface to the co-polar component of the far field. It should be noted that the operator $A_{co}$ expresses a non-linear relation between the unknowns $(\underline{a}, \underline{b})$ and the far field. The choice of separately determining the modulus and phase of the field is related to the need to impose constraints of a different nature on each of the quantities. Alternatively, it is possible to use other types of syntheses, for example based on the use of prolate spheroidal functions [18], in which $\mathcal{A}\exp(j\mathcal{F})$ is sought with regard to the complex field.

It should be noted that the present first optimization stage involves a global algorithm for the purpose of identifying a suitable starting point for the subsequent stages.

Naturally the global optimization algorithm selected for this purpose must be effective from the computational point of view, especially when antennas of large electrical dimensions are to be synthesized.

Among the different available choices of effective and efficient algorithm, an algorithm of the "multistart" type may be selected, which is able to nest local optimizations within the global search. The multistart procedure randomly generates in a uniform way starting points for local search in a "feasible" region in order to obtain an exhaustive mapping of the local minima of the functional $\phi$ and thereby determine the global minimum of the functional. For the multistart algorithm, the Multi Level Single Linkage (MLSL) method may be used, which proves to be particularly effective and efficient in avoiding unnecessary local searches and in guaranteeing convergence towards the global minimum with unitary probability. Naturally, different choices for the global optimization algorithm to be used are possible.

Downstream of the global optimization outcome, the outcome may possibly be refined by increasing $N_A$ and $N_F$ and searching for the design parameters by means of a local optimization algorithm in respect of which the previous global optimization outcome is selected as the starting point. The use of local optimization means that the burdens of global optimization can be avoided.

It should be borne in mind that fast calculation of the operator $A_{co}$ and of the functional gradients can be obtained by using the p series technique [6] and non-uniform Fourier transforms (NUFFT) (that have the typical computational complexity O(N log N) of standard FFTs) which will be described, for the sake of presentational convenience, in the following paragraphs with reference to the phase-only model "with array factor".

3.2. Phase-Only Model "with Array Factor" of the Field Radiated by an Aperiodic Conformal (Multi)-Reflectarray The second stage in the synthesis process is based on a simplified model, known as a "phase-only model", of the field radiated by the aperiodic conformal (multi)-reflectarray, which is hereinafter described together with the computational advantages comprised therein (also through the possibility of defining an array factor) in terms of resolving the direct problem at every stage of iteration and evaluating the gradient of the functionals involved.

It should be noted first of all that (1) does not have the form in respect of which FFT algorithms can be used to resolve the direct problem, as required by the iterative synthesis algorithm.

However, it is possible to simplify the model (1), on the one hand disregarding some of the dependences and on the other hand taking appropriate account of the curve in the reflective surface, so that relations calculable by means of NUFFT algorithms are rapidly re-established.

The definition (x', y') is given to the plane which minimizes the average distance of the points on the reflective surface and the projections thereof on the plane (x', y') itself (see FIG. 4). If the individual radiating elements are not electrically large and the reflective surface is sufficiently smooth and does not depart significantly from the plane (x', y'), then, with reference to the vectoral aspects, the planes $(\xi_n, \eta_n)$ may be considered parallel to each other and parallel to the plane (x', y'), so that the scattering mechanism can be approximately determined assuming that all the patches lie in the plane (x', y') itself.

Again, since the individual radiating elements are not electrically large, as the feed usually is (a hypothesis which is excluded when a feed cluster of large electrical dimensions is concerned), the scattering behaviour of the individual patches may be assumed to be the same, provided that the angle subtended from the reflective surface in O is suitably small in relation to the radiative characteristics of the feed. To sum up, the dependence of the scattering matrix on $u_n$ and $v_n$ can be disregarded. Lastly, in accordance with a phase-only model of the radiated field, the dependence of the scattering matrix on the patch characteristics is described by the phase factor $\exp(j\Psi_n)$ alone and by a term $\underline{S}_0$ common to all the elements $\underline{S}_n$, namely, $\underline{S}_n(u, v) \equiv S_0(u, v)\exp(j\psi_n)$.

As regards the primary field, and in accordance with the above, $\underline{E}_f$ can be approximated as $$\underline{E}_{f_n} \cong \tilde{\underline{E}}_f \cos^{m_f} w_n \frac{e^{-j\beta r_n}}{r_n} \tag{12}$$

where $\tilde{\underline{E}}_f = (\underline{E}_f \cdot \hat{i}_{x'}, \underline{E}_f \cdot \hat{i}_{y'})$ $\tilde{\underline{E}}_f = (\underline{E}_f \cdot \hat{i}_{x'}, \underline{E}_f \cdot \hat{i}_{y'})$ is a vector independent from subscript n, such that the vectoral variations of the primary field from patch to patch are neglected, $w_n = \sqrt{1-u_n^2-v_n^2}$ and $r_n = |O_n - O|$. In (12), a pattern of the type $\cos^{m_f} w_n$, typically sufficient in PO models, has been assumed, even if this does not represent an unambiguous choice, such that other types of pattern can be used, also "exactly" calculated and represented by means of basis function expansions such as spherical harmonics for example.

The vectoral aspects can be further simplified in (1) it being stressed that, the planes $(\xi_n, \eta_n)$ having been assumed to be parallel to x'y', then $\underline{Q}_n \cong \underline{Q}$.

That said, therefore, the eq. (1) can be rewritten as $$\begin{pmatrix} E_{co} \\ E_{cr} \end{pmatrix}(u, v) = \frac{e^{-j\beta r}}{r} \underline{Q}(u, v) \underline{S}_0(u, v) \tilde{\underline{E}}_f \sum_{n=1}^{N} \cos^{m_f} w_n \frac{e^{-j\beta r_n}}{r_n} e^{j\psi_n} e^{j\beta(ux_n + vy_n + wz_n)} \tag{13}$$

i.e., as product of an "element factor" $\underline{Q}(u, v)\underline{S}_0(u, v)\tilde{\underline{E}}_f$ and an "array factor"

$$F(u, v) = \sum_{n=1}^{N} \cos^{m_f} \theta_n \frac{e^{-j\beta r_n}}{r_n} e^{j\psi_n} e^{j\beta(ux_n + vy_n + wz_n)}, \tag{14}$$

containing the control phases $\psi_n$ necessary for beam shaping and which the synthesis algorithm acts upon.

3.3. Fast Evaluation of the Radiated Field in Respect of the Phase-Only Model "with Array Factor"

Downstream of the simplifications carried out previously, and rewriting the array factor (14) as $$F(u,v) = \Sigma_{n=1}^{N} a_n e^{j\beta(ux_n + vy_n + wz_n)}, \tag{15}$$

supposing $$a_n = \cos^{m_f} w_n \frac{e^{-j\beta r_n}}{r_n} e^{j\psi_n},$$

it emerges that, generally speaking, the relation (13) does not represent a Fourier transform relation between the patch excitations and the far field, since, for a non-planar reflectarray, $z_n \neq 0$. Therefore, fast algorithms based on the use of FFT are not immediately usable.

To speed up calculation of the radiated field and restore Fourier transform relations, an approximate approach is used based on the use of the so-called p series.

Figure 6:
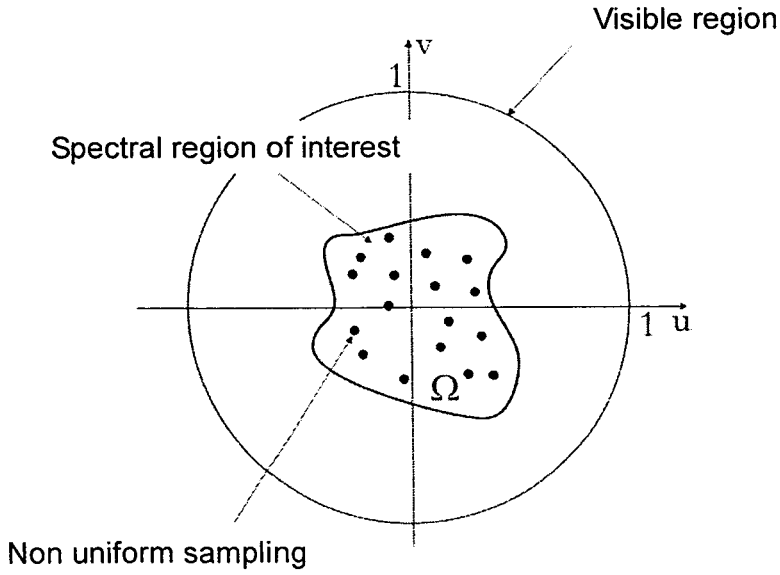
FIG. 6, a non-uniform sampling layout of a region of the (u, v) plane.

In principle, even downstream of said approach, it is not possible to evaluate the transform relations deriving therefrom by means of standard FFT algorithms, in as much as the reflectarray elements are not arranged on a uniform rectangular Cartesian grid as required by a standard FFT. Additionally, the design specification could themselves not be imposed on a rectangular cartesian grid of the plane (u, v) (see FIG. 6).

For this reason, NUFFT algorithms can be used to manage such cases with a computational complexity proportionate to that of a standard FFT, i.e. of the type O(N log N).

To illustrate in further detail the computational aspects of the calculation of the radiated field, it is observed that the representation in terms of p series applied for the first time in respect of the fast reflectarray analysis in [6], can be used to good effect. In this way, depending on the curve in the reflectarray surface, the computational cost may be modulated without abandoning the use of an accurate algorithm based on massive use of NUFFT algorithms.

Denoting by $(u_0, v_0, w_0)$ the values of (u, v, w) related to the beam pointing direction, eq. (15) may be rewritten as $$F(u',v') = \Sigma_{n=1}^{N} a'_n e^{j\beta[u'x_n + v'y_n + w'z_n]}, \tag{16}$$

with $u' = u - u_0$, $v' = v - v_0$, $w' = w - w_0$ and $a'_n = a_n \exp\{u_0 x_n + v_0 y_n + w_0 z_n)\}$.

In directions close to the beam pointing direction and for small curvatures of the reflective surface, the exponential term $\exp[jw'z_n]$ may be expanded in the Taylor series stopping at the P-th order, such that $$F(u', v') = \sum_{p=0}^{P-1} \frac{(j\beta w')^p}{p!} \sum_{n=1}^{N} z_n^p a'_n e^{j\beta[u' x_n + v' y_n]}. \tag{17}$$

Each summation in (17) may be evaluated by using an NUFFT routine. In further detail, if the design constraints are specified with regard to uniform cartesian grids of the plane (u, v), then NUFFT routines of the NED (Non-Equispaced Data) type, also known as type 2, must be used. Conversely, for specifications assigned to arbitrary spectral ranges, then type 3 NUFFTs are required.

Through the p series-based approach, the computational complexity of the calculation of each radiated field becomes O(PN log N), i.e. proportionate to the computational complexity of a standard FFT. Lastly, to further speed up the computation, optimized procedures such as the so-called FFTW may be employed for the calls to standard FFTs required by the NUFFT procedures.

3.4. Stage #2: Synthesis Based on the Phase-Only Model "with Array Factor" and Search for Control Phases Alone The purpose of the second stage is to provide a first determination of the patch control phases in accordance with the model in (13).

To this end, the local density, and therefore the positions $(x_n, y_n)$, of the reflective elements are fixed in accordance with the modulus A identified at the previous stage, a surface of equation $z=g_0(x, y)$, equal to that used in stage #1 is considered, while the patches are orientated in the same way, selecting $\underline{\theta}=\underline{\theta}_0$ and $\underline{\phi}=\underline{\phi}_0$, in accordance with the polarization required for the radiated field.

As regards the control phases, in order to allow an appropriate choice of the number of parameters to be sought and to allow the imposition of constraints (paragraph 4.1), they are represented by means of an appropriate modal expansion $$\psi_n = \Sigma_{t=1}^{T} c_t \Psi_t(x_n, y_n) \tag{18}$$

so that the parameters to be identified at this stage become the coefficients $\underline{c}=(c_1, c_2, \ldots, c_T)$. In other words, still assuming power pattern synthesis, downstream of the use of the phase-only model and of the representation (18), the functional to be optimized in this stage becomes:

$$\Phi(\underline{c}) = \|A_{co}(\underline{C}) - \boldsymbol{P}_{\mathcal{H}}(A_{co}(\underline{c}))\|^2 + \|A_{cr}(\underline{c}) - \boldsymbol{P}_{\mathcal{H}}(A_{cr}(\underline{c}))\|^2 \tag{19}$$

where now the operator $\underline{A}=(A_{co}, A_{cr})$ connects the control phases, according to the representation (18), to the co-polar and cross-polar components of the far field.

A typical choice for the aforementioned expansion functions is polynomial, even though other choices are of course possible. For example, Zernike polynomials can be used to represent the control phases under a phase-only model, in as much as said polynomials have the advantage of immediate interpretation in terms of aberration of the wave front of the radiated field.

3.5. Stage #3: Synthesis Based on the Phase-Only Model "with Array Factor" and Search for Control Phases, Patch Positions and Reflective Surface The task of this stage is to 1. provide a first solution as regards the reflective surface based on the initial choice $z=g_0(x, y)$, 2. update the positions $(x_n, y_n)$ of the reflective elements set at stage #1, 3. refine the solution identified at stage #2 as regards the patch control phases, maintaining the patch orientations fixed at the values $\underline{\theta}_0$ and $\underline{\phi}_0$.

To this end, and to allow an appropriate choice of the number of parameters to be sought and to allow the imposition of constraints (paragraph 5), both the positions of the reflective elements and the reflective surface are represented by means of appropriate modal expansions.

As regards the reflective surface, the representation (2) is used, in which the unknowns are contained in $\underline{s}$.

As regards the positions, the plane (x, y) is seen as a two-dimensional Riemannian manifold, with acceptable representation $$(x,y) = (h(p,q), l(p,q)) \tag{20}$$

where, as usual, the functions h and l are represented with a modal expansion in which $$\begin{cases} h(p, q) = \sum_{r=1}^{R} \alpha_r H_r(p, q) \\ l(p, q) = \sum_{r=1}^{R} \beta_r L_r(p, q) \end{cases} \tag{21}$$

$H_r$ and $L_r$ are expansion functions and $\alpha_r$ and $\beta_r$ are the unknown expansion coefficients.

In particular, it is possible to resort to representations by means of analytical functions, associating a complex number with the pair of coordinates.

Based on (10) and (11), it shall be supposed:

$$(x_n, y_n) = (h(p_n, q_n), l(p_n, q_n)) \tag{22}$$

where $(p_n, q_n)$ defines, for example, a uniform grid in $(-1.1)\times(-1.1)$.

As regards the control phases, each is sought individually as an unknown, i.e. $\psi_t=\delta(x_t-x_n, y_t-y_n)$ is assumed, so that the coefficients $c_t$ coincide with the control phases themselves.

Still assuming power pattern synthesis, the functional to be optimized in this stage is $$\Phi(\underline{\alpha}, \underline{\beta}, \underline{s}, \underline{c}) = \|A_{co}(\underline{\alpha}, \underline{\beta}, \underline{s}, \underline{c}) - \boldsymbol{P}_{\mathcal{H}}(A_{co}(\underline{\alpha}, \underline{\beta}, \underline{s}, \underline{c}))\|^2 + \|A_{cr}(\underline{\alpha}, \underline{\beta}, \underline{s}, \underline{c}) - \boldsymbol{P}_{\mathcal{H}}(A_{cr}(\underline{\alpha}, \underline{\beta}, \underline{s}, \underline{c}))\|^2 \tag{23}$$

where now the operator $\underline{A}=(A_{co}, A_{cr})$ connects the unknowns, according to representations (2), (18), (20), (21) and (22), to the co-polar and cross-polar components of the far field, ed. $\underline{\alpha}=\alpha_1, \alpha_2, \ldots, \alpha_R)$ and $\underline{\beta}=(\beta_1, \beta_2, \ldots, \beta_R)$.

3.6. Phase-Only Model "without Array Factor" of the Field Radiated by an Aperiodic Conformal (Multi)Reflectarray The fourth stage in the synthesis process is based on a simplified phase-only model of the radiated field, but nonetheless more accurate relative to that derived in paragraph 3.2, in as much as it does not use the array factor.

In fact, based on the model described by the eq. (1), only $\underline{S}_n(u, v)=\tilde{\underline{S}}_n(u, v)\exp(j\psi_n)$ is assumed, i.e. the dependence of the scattering matrix on the internal design parameters of the patch is applied only to a phase factor $\exp(j\psi_n)$.

In other words, the radiated field is represented as $$\begin{pmatrix} E_{co} \\ E_{cr} \end{pmatrix}(u, v) = \frac{e^{-j\beta r}}{r} \sum_{n=1}^{N} \underline{\underline{Q}}_n(u, v) \underline{\underline{\tilde{S}}}_n(u, v) e^{j\psi_n} \underline{E}_{f_n} e^{j\beta(ux_n + vy_n + wz_n)}. \tag{24}$$

As can be seen, in accordance with this model it is no longer possible to identify an element factor and an array factor for the radiated field as in (13), and therefore it is not possible to reduce the fast solution of the direct problem, as in paragraph 3.2. However, it is possible to refer the numerical calculation of the radiated field to matrix-vector products and to use, for this purpose, the optimized matrix-vector products, as indicated in the following paragraph.

3.7. Fast Evaluation of the Radiated Field by Means of the Phase-Only Model "without Array Factor" and the Accurate Model As has been said, the models in the eq. (1) and (24) do not allow the use of algorithms based on NUFFT owing to the fact that it is not possible to define the radiated field as the product of an element factor and an array factor.

However, assuming that the design specifications are assigned in a number M of points in Ω, then the eq. (1) and (24) may be rewritten as a matrix-vector product, i.e. as $$\underline{E} = \begin{pmatrix} \underline{E}_{co} \\ \underline{E}_{cr} \end{pmatrix} = \underline{B}\underline{E}_f, \tag{25}$$

where $\underline{E}$ is now understood as a vector of 2M elements containing the values of the co-polar and cross-polar components of the radiated field in the M directions of Ω in which the design specifications are assigned, $\underline{E}_f$ is understood as a vector of 2N elements containing the components along x and y of the primary field incident on the reflective surface, while $\underline{B}$ is an appropriate matrix of 2M×2N elements. The radiated field may therefore be evaluated, under the models explained in the previous paragraphs, as the matrix-vector product of a matrix 2N×2N and a vector 2N×1

Said product can be evaluated as a succession of sums and column-row products or, more effectively, through optimized procedures for the calculation of matrix-vector products of the Strassen-Winograd type. The first approach has a computational complexity of the $N^2$ type, while said optimized procedures are superior in performance, having a computational complexity that hits $N \log^5 N$, depending on the symmetries of the matrix $\underline{B}$ which it is possible to use.

3.8. Stage #4: Synthesis Based on the Phase-Only Model without Array Factor and Search for Control Phases, Patch Positions and Reflective Surface The task of this stage is to 1. refine the solution in terms of reflective surface based on the outcome of stage #3, 2. update the positions $(x_w, y_n)$ of the reflective elements obtained at stage #3, 3. refine the solution identified at stage #3 as regards the patch control phases, maintaining the patch orientations fixed at the values $\underline{\theta}_0$ and $\underline{\phi}_0$.

To this end, the representations (1), (20), (21) and (22) are used, $\psi_t=\delta(x_t-x_n, y_t-y_n)$, and the operator $\underline{A}$ involved in the functional (23) uses the model in (24).

3.9. Stage #5: Synthesis Based on the Accurate Model

The task of the final stage in the synthesis process is to identify the final solution of the synthesis using the model in (1), and searching, relative to the previous stages, for the control parameters $\underline{D}$ instead of the control phases and the orientations $\underline{\theta}$ and $\underline{\phi}$ which were set first. Moreover, as in the previous stages, the solutions are refined in terms of reflective surfaces, again using a modal expansion of type (2), and position of the scatterer elements on the reflective surface which are now sought individually avoiding (20), (21) and (22).

Referring once again to the power pattern synthesis case, the functional to be optimized is given by (8)

If necessary, to reduce the complexity of this synthesis stage, some unknowns (for example, the surface equation) can be accepted as fixed and equal to the value identified at stage #4.

3.10. Fast Gradient Evaluation in Respect of the Phase-Only Model "with Array Factor"

Evaluation of the gradient of the functionals Φ, as defined in (18) and (23), requires the evaluation of their derivatives relative to the parameters to be identified.

To illustrate the fast gradient calculation, we will here refer, for the sake of simplicity, to the case of (18), to the derivatives of Φ relative to the coefficients of expansion of the control phases and to the single term $\Phi_{co}$ due to the co-polar components of the field, i.e.

$$\Phi_{co}(\underline{c}) = \|A_{co}(\underline{c}) - \boldsymbol{P}_{\mathcal{H}}(A_{co}(\underline{c}))\|^2 \tag{26}$$

It is possible to show that $$\frac{\partial \Phi_{co}}{\partial c_t} = 4\mathcal{R}e\left\{\sum_{p=0}^{P-1} \frac{(j\beta w')^p}{p!} \left\langle \sum_{n=1}^{N} z_n^p \frac{\partial a'_n}{\partial c_t} e^{j\beta[u'x_n+v'y_n]}, |E_{co}|^2[|E_{co}|^2 - \underline{P}_U(|E_{co}|^2)] \right\rangle_{W(\Omega)}\right\} \tag{27}$$

where $\langle .,. \rangle_{W(\Omega)}$ is the standard scalar product in W(Ω).

Said scalar product can be effectively evaluated in the transform domain, using the Parseval identity and NUFFT routines. In fact, the discrete transform of the term $|E_{co}|^2[|E_{co}|^2-\underline{P}_U(|E_{co}|^2)]$ can be evaluated by a NUFFT of the NED type, while the discrete transform of the term $$\sum_{n=1}^{N} z_n^p \frac{\partial a'_n}{\partial c_t} e^{j\beta[u'x_n+v'y_n]}$$

coincides with $$z_n^p \frac{\partial a'_n}{\partial c_t}.$$

According to the same layout, it is possible to evaluate the derivatives of the functional in (23) relative to the other parameters to be identified.

3.11. Fast Gradient Evaluation in Respect of the Phase-Only Model "without Array Factor" and the Accurate Model As for the previous paragraph, we will here refer, for the sake of simplicity, to the contribution to the functional defined in (4) due to the single co-polar component of the radiated field, i.e.

$$\Phi_{co}(\underline{x},\underline{y},\underline{s},\underline{D},\underline{\theta},\underline{\phi}) = \|A_{co}(\underline{x},\underline{y},\underline{s},\underline{D},\underline{\theta},\underline{\phi}) - \boldsymbol{P}_{\mathcal{H}}(A_{co}(\underline{x},\underline{y},\underline{s},\underline{D},\underline{\theta},\underline{\phi}))\|^2 \tag{28}$$

Moreover, to illustrate fast gradient calculation, it will be referred here, for the sake of simplicity, to the definition of the derivatives of Ω with respect to the control parameters relative to the use of the accurate model, those relative to the use of the phase-only model "without array factor" being similar.

For this purpose, taking account of (1) and with reference to the field patterns, it is possible to see that $$\frac{\partial \Phi_{co}}{\partial d_{nj}} = 4\mathrm{Re}\int_{\Omega} \underline{Q}^{T}_{co_n}(u, v) \cdot \frac{\partial \underline{S}_n}{\partial d_{nj}} \cdot \underline{E}_{f_n} e^{j\beta(ux_n+vy_n+wz_n)} E^{*}_{co}(u, v)(|E_{co}(u, v)|^2 - P_{\mathcal{H}}(|E_{co}(u, v)|^2))\, du dv \tag{29}$$

where $Q_{co_n}^{T}(u, v)$ is the row of $Q_n(u, v)$ relative to the co-polar component of the field.

Similarly to the evaluation of the radiated field discussed in paragraph 4.6, the integral contained in (29), once discretized, can also be reformulated as a matrix-vector product and therefore evaluated with optimized algorithms for matrix-vector multiplication.

Naturally, according to the same layout, it is possible to evaluate the functional derivatives as regards the other different parameters to be identified.

3.12. Storage and Evaluation of the Hessian Matrix

The definition of the Hessian matrix and the procedures for updating same, relative to the BFGS algorithm, are well known, and are not repeated here.

It should however be observed how, to limit the memory occupation of the Hessian matrix, possible symmetries, such as $H_{ij}=H_{ji}$ for example where $H_{ij}$ is the generic element of the matrix, can be used. In this way, the memory occupation may be significantly reduced by half and moreover the organization of the data deriving therefrom also allows an improvement in storage access times.

Lastly, it is observed how the matrix-vector and vector-vector products involved in the evaluation and in the updating of the Hessian matrix can in their turn be implemented using optimized procedures similar to those indicated previously.

3.13. Use of Subarrays

The idea underpinning the use of subarrays is the implementation of a multi-level approach comprising subdividing the reflective surface into sub-surfaces (subarrays), if necessary into a multi-level structure, evaluating the field radiated (phase-only or accurate, depending on the model of interest, and therefore through NUFFT routines or optimized matrix-vector multiplication routines, respectively) by each subarray and then superposing the results. Multi-level approaches are generally speaking able to reduce further the computational complexity and can be of serious interest if it is necessary to take surfaces into consideration 4. Constraints The synthesis algorithm described above may be provided with appropriate procedures capable of satisfying constraints in relation to the geometry of the reflective surface, the geometric characteristics of the individual radiating elements, the maximum inter-element distances tolerated, and constraints imposed by the electromagnetic models used.

For example, as far as stage #1 is concerned, the modulus of the field on the reflective surface determines initial reflective element positioning and the inter-element distance between the different patches must be sufficiently large to prevent mutual coupling effects, but sufficiently small so as to control the effectiveness of the reflective surface and the overall dimensions of the antenna.

Moreover, as far as the synthesis at stages #1-4 is concerned, it should be remembered that the reflective surface layout is characterized downstream of control phase identification. Consequently, an unconstrained synthesis of the control phases may produce non-implementable phase variations between element and element.

Lastly, constraints with regard to the geometry of the reflective surface may be due to constructional limitations or to limitations due to the characteristics of the antenna installation site.

4.1. Constraints with Regard to the Amplitude Distribution of the Field on the Reflective Surface Relative to Stage #1 (Function $\mathcal{A}$)

To illustrate one way to force constraints with regard to the function A dynamic, at each iteration relative to the minimization of the functional (IV.4), a new function A' is defined linked to the previous one through the relation $$\mathcal{A}' = \kappa \mathcal{A} + \rho, \tag{30}$$

in which the coefficients κ and ρ are selected in such a way that $\mathcal{A}_{min} \leq \mathcal{A}' \leq \mathcal{A}_{max}$, where $A_{min}$ and $A_{max}$ characterize the minimum and maximum acceptable value for modulus A.

4.2. Constraints with Regard to Control Phase Variations and to the Phase Distribution of the Field on the Reflective Surface Relative to Stage #1 (Function $\mathcal{F}$)

To illustrate the forcing of the maximum acceptable phase variation between adjacent elements, we will here refer, for the sake of simplicity, to the control phase case, the forcing of constraints with regard to the phase function $\mathcal{F}$ of the field on the reflective surface involved in stage #1 being entirely similar.

To effectively impose a constraint with regard to the maximum phase variation between consecutive elements, at each iteration stage a phase distribution ψ' or can be defined linked to ψ by means of a positive scaling constant α, i.e.

$$\psi'(x,y) = \alpha\psi(x,y). \tag{31}$$

By varying the scaling constant it is possible to stretch or compress the phase distribution, so as to ensure that the maximum phase variation Δψ' between adjacent elements is less than a maximum acceptable phase shift $\overline{\Delta\psi}$. In other words, the scaling constant α can be selected so that $$\max_{x,y}|\Delta\psi'| = \alpha\max_{x,y}|\Delta\psi| = \alpha\max_{x,y}|\underline{\nabla}\psi \cdot \underline{v}| \leq \overline{\Delta\psi} \tag{32}$$

where $\underline{\nabla}\psi$ is the gradient of ψ, and $\underline{v}$ is the vector which characterizes the position of the element adjacent to the one considered. In particular the maximum of $|\underline{\nabla}\psi \cdot \underline{v}|$ may be easily evaluated once note is taken of the geometry of the antenna and the unknowns considered during the generic synthesis stage, so that it is possible to identify the scaling constant which guarantees full satisfaction of the constraint with regard to the maximum phase shift.

4.3. Constraints with Regard to the Geometry of the Reflective Surface

Constraints with regard to the reflector geometry may, on account of constructional limitations and/or to make the surface compatible with simplified electromagnetic models, require the surface to be mildly variable. In this event, it is possible to impose a constraint on the maximum acceptable value C of the modulus of the gradient of the function g, i.e. to impose $$|\underline{\nabla} g| = \sqrt{\left(\frac{\partial g}{\partial x}\right)^2 + \left(\frac{\partial g}{\partial y}\right)^2} \leq C. \tag{33}$$

Once again, one way of imposing said constraint verifying (33) can be obtained by defining, at each iteration stage, a new surface of equation z=g'(x, y) linked to g by means of a positive scaling constant α, i.e.

$$g'(x,y)=\alpha g(x,y). \tag{34}$$

By varying the scaling constant it is possible to stretch or compress the surface, so as to satisfy (33). In other words, the scaling constant α can be selected so that $$\max_{x,y}|\underline{\nabla} g'| = \alpha \max_{x,y}|\underline{\nabla} g| \leq C. \tag{35}$$

In (35), the uniform norm has been used to evaluate the spatial variability of the function g. Naturally, other measurements, for example evaluations in quadratic norm, may alternatively be used.

4.4. Constraints with Regard to Maximum and Minimum Inter-Element Spacing

As regards the forcing of constraints with regard to maximum and minimum spacing between the reflective elements, it should be remembered at this point that the plane (x, y) has been assumed to be a Riemann manifold of coordinates (p, q). Therefore, the metric tensor $g_{ij}$ is defined thereon, where $g_{11}=\partial h/\partial p$, $g_{12}=\partial h/\partial q$, $g_{21}=\partial l/\partial p$, $g_{22}=\partial l/\partial q$.

To obtain, for the sake of simplicity, a conversion of orthogonal coordinates into orthogonal coordinates, it must be that $g_{12}=g_{21}=0$, so that $$dx=g_{11}dp \tag{36}$$

and $$dy=g_{22}dq. \tag{37}$$

Therefore, imposing $$1 \leq g_{11} < m_1 \tag{38}$$

and $$1 \leq g_{22} < m_2, \tag{39}$$

the constraint with regard to the minimum distance may be imposed by selecting the uniform grid spacing ($p_n$, $q_n$) equal to the acceptable minimum, while the constraint with regard to the maximum distance is imposed through an appropriate choice of the constants $m_1$ and $m_2$, for example, with a methodology similar to that described in paragraph 4.1.

It is appropriate to stress that in truth the constraint would be imposed with reference to the distance between the elements (adjacent and non-adjacent) in the space (x, y, z) or along the reflective surface, possibly taking into account the electromagnetic characteristics of the substrate. In the case of substrates with low permittivity, the constraint imposed on the distance in the space (x, y, z) may prove to be sufficient.

In the case examined, the distance is evaluated with reference to the points in the manifold (x, y). However the inequality:

$$(x_n-x_m)^2+(y_n-y_m)^2 \leq (x_n-x_m)^2+(y_n-y_m)^2+(z_n-z_m)^2 \tag{40}$$

ensures that, for smooth reflective surfaces, the constraint is satisfied in the space (x, y, z) without excesses.

Moreover, it is necessary to point out that, since the reflective surface is a pattern surface relative to the axis z, attention needs to be paid solely to the distances between adjacent elements, with huge savings in terms of computational complexity.

4.5. Calculation of the Gradients in the Presence of Constraints

In the event of the procedures previously described in detail being applied to satisfy the design constraints, the gradient expressions indicated in paragraphs 3.10 and 3.11 prove to be more complex. However the relevant calculation can be made by applying Dini's theorem and speed-ups similar to the above can be obtained.

5. Beam Reconfigurability

Where a steered beam or electronically reconfigurable antenna is required, each patch will be provided with a set of control signals (voltages, for example), collected inside a matrix $\underline{V}$, which will be the target of the synthesis in addition to the abovementioned parameters. In other words, functional dependence on the matrix $\underline{V}$ is added to the scattering matrix in (1).

The specifications will refer to each beam, and the functional in (2), will be modified in consideration of the sum of the inputs relative to the individual beams, i.e.:

$$\begin{aligned}\Phi(\underline{x},\underline{y},\underline{s},\underline{D},\underline{V}_1,\underline{V}_2,\ldots,\underline{V}_{N_F},\underline{\theta},\underline{\phi}) = \Sigma_{i=1}^{N_F}\{&\|A_{co}(\underline{x},\underline{y},\underline{s},\underline{D},\\ &\underline{V}_i,\underline{\theta},\underline{\phi}) - \boldsymbol{P}_{\mathcal{H}}(A_{co}(\underline{x},\underline{y},\underline{s},\underline{D},\underline{V}_i,\underline{\theta},\underline{\phi}))\|^2 + \|A_{cr}(\underline{x},\underline{y},\underline{s},\underline{D},\\ &\underline{V}_i,\underline{\theta},\underline{\phi}) - \boldsymbol{P}_{\mathcal{H}}(A_{cr}(\underline{x},\underline{y},\underline{s},\underline{D},\underline{V}_i,\underline{\theta},\underline{\phi}))\|^2\}\end{aligned} \tag{41}$$

The functionals involved in synthesis stages #1-4 are modified in a similar way. In particular, in consideration of stage #2 for example, using the phase-only model "with array factor", each beam will be characterized by a control phase vector $\underline{\psi}_i$, where the subscript i characterizes the i-th beam. Taking into account (18), (19) is therefore modified as $$\begin{aligned}\Phi(\underline{c}_1,\underline{c}_2,\ldots,\underline{c}_{N_F}) = \Sigma_{i=1}^{N_F}\{&\|A_{co}(\underline{c}_i) - \\ &\boldsymbol{P}_{\mathcal{H}}(A_{co}(\underline{c}_i))\|^2 + \|A_{cr}(\underline{c}_i) - \boldsymbol{P}_{\mathcal{H}}(A_{cr}(\underline{c}_i))\|^2\}\end{aligned} \tag{42}$$

REFERENCES

[1]. O. M. Bucci, A. Capozzoli, G. D'Elia, S. Musto, "A new approach to the power pattern synthesis of reflectarrays", *Proc. of the* 2004 *URSI EMTS Symp.*, Pisa, Italy, May 23-27, 2004, pp. 1053-1055.

[2]. O. M. Bucci, A. Capozzoli, G. D'Elia, P. Maietta, S. Russo, "An advanced reflectarray design technique", *Proc. of the* 28$^{th}$ *ESA Antenna Workshop on Space Antenna Syst. and Tech., Noordwijk, The Netherlands, May* 31-Jun. 3, 2005, pp. 455-459.

[3]. O. M. Bucci, A. Capozzoli, G. D'Elia, S. Russo, "Power pattern synthesis of reflectarrays: comparison between two approaches", *Proc. of the XV Riunione Nazionale di Elettromagnetismo*, Cagliari, Italy, Sep. 13-16, 2004, CD ROM.

[4]. A. Capozzoli, G. D'Elia, S. Russo, M. Tutucci, "Power pattern synthesis of reconfigurable shaped-beam reflectarrays", *Proc. of the 9th Int. Conf. on Electromagn. in Adv. Appl.*, Turin, Italy, Sep. 12-16, 2005, pp. 819-822.

[5]. L. Marnat, R. Loison, R. Gillard, D. Bresciani, H. Legay, <<Accurate Synthesis of a Dual Linearly Polarized Reflectarray>>, 3rd EUCAP, European Conference on Antennas and Propagation, Berlin, March 2009.

[6]. A. Capozzoli, C. Curcio, G. D'Elia, A. Liseno, "Fast power pattern synthesis of conformal reflectarrays", *Proc.*

*of the IEEE Int. Symp. on Antennas Prop.*, San Diego, Calif., Jul. 5-11, 2008, CD ROM.

[7]. A. Capozzoli, G. D'Elia, "Global optimization and antennas synthesis and diagnostics, part one: concepts, tools, strategies and performances", *Progr. Electromagn. Res. PIER*, vol. 56, pp. 195-232, 2006.

[8]. A. Capozzoli, C. Curcio, G. D'Elia, A. Liseno, "Power pattern synthesis of multifeed reconfigurable reflectarrays", *Proc. of the 29th ESA Antenna Workshop on Multiple Beams Reconfig. Antennas*, Noordwijk, The Netherlands, Apr. 18-20, 2007, CD ROM.

[9]. C. A. Balanis, Antenna Theory: Analysis and Design, John Willey & Sons, New York, 1997.

[10]. M. Frigo, S. G. Johnson, "The design and implementation of FFTW," *Proc. of the IEEE*, vol. 93, n. 2, pp. 216-231, Feb. 2005.

[11]. M. Bläser, "Lower bounds for the multiplicative complexity of matrix multiplication", *Comput. Complex.*, vol. 8, n. 3, pp. 203-226, December 1999.

[12]. K. Fourmont, "Non-equispaced fast Fourier transforms with applications to tomography," *J. Fourier Anal. Appl.*, vol. 9, n. 5, pp. 431-450, September 2003.

[13]. J. Y. Lee, L. Greengard, "The type 3 nonuniform FFT and its applications", *J. Comput. Phys.*, vol. 206, n. 1, pp. 1-5, June 2005.

[14]. A. H. G. Rinnooy Kan, G. T. Timmer, "Stochastic global optimization methods part I: clustering methods", *Math. Program.*, vol. 39, n. 1, pp. 27-56, September 1987.

[15]. A. H. G. Rinnooy Kan, G. T. Timmer, "Stochastic global optimization methods part II: multi level methods", *Math. Program.*, vol. 39, n. 1, pp. 57-78, September 1987.

[16]. O. M. Bucci, A. Capozzoli, C. Curcio, G. D'Elia, "The scattering matrix for reflectarray antennas", Atti della Fondazione Giorgio Ronchi, LXV, 1, 17 (2010).

[17]. M. Bucci, G. Franceschetti, G. Mazzarella, G. Panariello, "Intersection approach to array synthesis", *IEE Proc. Pt. H, Microw., Antennas Prop.*, vol. 137, n. 6, pp. 349-357, December 1990.

[18]. A. Capozzoli, C. Curcio, G. D'Elia, A. Liseno, P. Vinetti, "*Sensitivity to Positioning Errors in Aperiodic Arrays*", XVII Riunione Nazionale di Elettromagnetismo (RiNEM), Lecce, Italy, 15-19 Sep. 2008.

[19]. C. Tienda, M. Arrebola, J. A. Encinar, G. Toso "Analysis of parabolic reflectarray in dual-reflector configuration" Proceedings of the Fourth European Conference on Antennas and Propagation (EuCAP), 2010

[20]. S. M. Meriah, E. Cambiaggio, F. T., Bendimerad, R. Staraj, J. P. Damiano, L. Brochier "Design of a thinned microstrip-antenna reflectarray using a genetic algorithm" Microwave and optical technology letters (MOTL), vol. 46, issue 6, pages 559-562, 20 Sep. 2005.

[21]. D. G. Kurup, M. Hindi, A. Rydberg, "Design of Unequally Speced Reflectarray", IEEE Antennas and Wireless Propagation Letters, Vol. 2, 2003.

The invention claimed is:

1. A method for manufacturing an aperiodic array of electromagnetic scatterers, said aperiodic array being one of a one dimensional aperiodic array and a two dimensional aperiodic array, the method comprising:

running a multi-step synthesis algorithm on a computer, said synthesis algorithm being configured for identifying values of a set of parameters, said set of parameters defining said aperiodic array as a cost function depending on design specifications, wherein said set of parameters are physical parameters, geometrical parameters or a combination thereof, wherein said multi-step synthesis algorithm is configured to identify said set of parameters of the aperiodic array by optimizing said cost function defined on said set of parameters, wherein said multi-step synthesis algorithm comprises the following steps:

a first synthesis step implemented in modulus and in phase for obtaining a modulus and a phase of the electromagnetic field, based on a continuous electromagnetic modelling of the aperiodic array, implementing the synthesis of an electromagnetic field on one of a pre-set reflecting line and a pre-set reflecting surface, said pre-set reflecting surface being continuous;

identifying an initial positioning of the electromagnetic scatterers as a function of the modulus of the electromagnetic field obtained by said first synthesis step, and identifying initial control phases of the electromagnetic scatterers as a function of the phase of the electromagnetic field obtained by said first synthesis step;

at least one of a first, a second and a third intermediate synthesis steps performing refinement of said initial control phases, subsequent to said first synthesis step, based on a discrete phase-only electromagnetic modelling of the aperiodic array, wherein each electromagnetic scatterer is only characterized by a phase factor, wherein:

the first intermediate synthesis step performing said refinement of said initial control phases, based on a phase-only model in which the electromagnetic field radiated by the aperiodic array is approximated by a product of an element factor and an array factor;

the second intermediate synthesis step performing said refinement of said initial control phases and of the positioning of the electromagnetic scatterers, and of the surface on which said scatterers are arranged, also based on a phase-only model in which the electromagnetic field radiated by the aperiodic array is approximated by said product of an element factor and an array factor;

the third intermediate synthesis step performing said refinement of said initial control phases and of the positioning of the electromagnetic scatterers, and of the surface on which said scatterers are arranged, based on a phase-only model in which the electromagnetic field radiated by the aperiodic array is not approximated by said product of an element factor and an array factor;

a final refinement synthesis step refining at least the positioning of the electromagnetic scatterers based on a more accurate electromagnetic modelling of the aperiodic array to identify values of the set of parameters of said aperiodic array; and identifying the orientation thereof and the physical design parameters thereof;

wherein every synthesis step of the multi-step synthesis algorithm, except said first synthesis step, takes as initial values of said parameters those provided by the previous synthesis step; and further to running said multi-step synthesis algorithm, physically making said aperiodic array of electromagnetic scatterers, wherein the identified values of said parameters obtained after said final refinement synthesis step are used for manufacturing the aperiodic array of electromagnetic scatterers corresponding to said identified values.

2. The method according to claim 1, wherein the parameters of the aperiodic array identified by the multi-step synthesis algorithm comprise parameters that define the geometry of one of a curved surface and a curved line, on which said electromagnetic scatterers are arranged aperiodically.

3. The method according to claim 1, wherein in the synthesis steps of said multi-step synthesis algorithm, except at most in said final refinement synthesis steps, the parameters to be identified are the coefficients of modal representations of appropriate functions.

4. The method according to claim 1, wherein the synthesis steps of said multi-step synthesis algorithm implement a constrained optimization of the cost function, with unilateral or bilateral nonholonomic constraints intended to ensure aperiodic array implementability.

5. The method according to claim 4, wherein said unilateral or bilateral nonholonomic constraints comprise at least one of the following:

a maximum value and a minimum value of the module of the electromagnetic field identified by the first synthesis step of the multi-step synthesis algorithm;

a maximum value of the variation of the phase of said electromagnetic field;

a maximum value and a minimum value of the spacing between two scatterers.

6. The method according to claim 1, wherein at least one of said intermediate synthesis steps is based on a calculation of the field radiated by the aperiodic array, implemented by means of non-uniform fast Fourier transforms.

7. The method according to claim 1 wherein, before said intermediate synthesis steps of the multi-step synthesis algorithm are run, an initial positioning of the electromagnetic scatterers is identified as a function of the modulus of the electromagnetic field obtained by said first synthesis step.

8. The method according to claim 1, wherein said multi-step synthesis algorithm comprises at least one first intermediate synthesis step based on a phase-only model in which the electromagnetic field radiated by the aperiodic array is approximated by said product of an element factor and an array factor.

9. The method according to claim 8, wherein said multi-step synthesis algorithm also comprises a final intermediate synthesis step based on a phase-only model in which the electromagnetic field radiated by the aperiodic array is not approximated by said product of an element factor and an array factor.

10. The method according to claim 1, wherein the scatterers of said aperiodic array are arranged aperiodically on a curved line or surface.

11. The method according to claim 1, wherein the physical or geometrical parameters of the aperiodic array identified by the synthesis algorithm comprise parameters that define the aperiodic arrangement of said electromagnetic scatterers on a supporting line or surface.

12. A method for manufacturing an aperiodic reflectarray antenna comprising an aperiodic array of electromagnetic scatterers, said aperiodic array being one of a one dimensional aperiodic array and a two dimensional aperiodic array, the method comprising:

running a multi-step synthesis algorithm on a computer, said synthesis algorithm being configured for identifying values of a set of parameters, said set of parameters defining said aperiodic array as a cost function depending on design specifications, wherein said set of parameters are physical parameters, geometrical parameters or a combination thereof, wherein said multi-step synthesis algorithm is configured to identify said set of parameters of the aperiodic array by optimizing said cost function defined on a set of parameters, wherein said multi-step synthesis algorithm comprises the following step:

a first synthesis step implemented in modulus and in phase for obtaining a modulus and a phase of the electromagnetic field, based on a continuous electromagnetic modelling of the aperiodic array, implementing the synthesis of an electromagnetic field on one of a pre-set reflecting line and a pre-set reflecting surface, said pre-set reflecting surface being continuous;

identifying an initial positioning of the electromagnetic scatterers as a function of the modulus of the electromagnetic field obtained by said first synthesis step, and identifying initial control phases of the electromagnetic scatterers as a function of the phase of the electromagnetic field obtained by said first synthesis step;

at least one of a first, a second and a third intermediate synthesis steps performing refinement of said initial control phases subsequent to said first synthesis step, based on a discrete phase-only electromagnetic modelling of the aperiodic array, wherein each electromagnetic scatterer is only characterized by a phase factor, wherein:

the first intermediate synthesis step performing said refinement of said initial control phases, based on a phase-only model in which the electromagnetic field radiated by the aperiodic array is approximated by a product of an element factor and an array factor;

the second intermediate synthesis step performing said refinement of said initial control phases and of the positioning of the electromagnetic scatterers, and of the surface on which said scatterers are arranged, also based on a phase-only model in which the electromagnetic field radiated by the aperiodic array is approximated by said product of an element factor and an array factor;

the third intermediate synthesis step performing said refinement of said initial control phases and of the positioning of the electromagnetic scatterers, and of the surface on which said scatterers are arranged, based on a phase-only model in which the electromagnetic field radiated by the aperiodic array is not approximated by said product of an element factor and an array factor; and a final refinement synthesis step refining at least the positioning of the electromagnetic scatterers based on a more accurate electromagnetic modelling of the aperiodic array to identify values of the set of parameters of said aperiodic array; and identifying the orientation thereof and the physical design parameters thereof;

wherein every synthesis step of said multi-step synthesis algorithm except said first synthesis step, takes as initial values of said parameters those provided by the previous synthesis step; and further to running said multi-step synthesis algorithm, physically making said aperiodic reflectarray antenna, wherein the identified values of said parameters obtained after said final refinement synthesis step are used for manufacturing the aperiodic array of electromagnetic scatterers corresponding to said identified values.

* * * * *